US011478115B2

(12) United States Patent
Imae et al.

(10) Patent No.: US 11,478,115 B2
(45) Date of Patent: Oct. 25, 2022

(54) AUTONOMOUS TRAVELING CLEANER

(71) Applicant: OMRON Corporation, Kyoto (JP)

(72) Inventors: Tomokazu Imae, Otsu (JP); Atsushi Mizoguchi, Hikone (JP)

(73) Assignee: OMRON CORPORATION, Kyoto (JP)

( * ) Notice: Subject to any disclaimer, the term of this patent is extended or adjusted under 35 U.S.C. 154(b) by 231 days.

(21) Appl. No.: 16/950,944

(22) Filed: Nov. 18, 2020

(65) Prior Publication Data

US 2021/0161341 A1 Jun. 3, 2021

(30) Foreign Application Priority Data

Dec. 3, 2019 (JP) ..... JP2019-218717

(51) Int. Cl.
*A47L 9/04* (2006.01)
*A47L 9/28* (2006.01)
*A47L 9/14* (2006.01)

(52) U.S. Cl.
CPC ..... *A47L 9/0488* (2013.01); *A47L 9/0455* (2013.01); *A47L 9/0477* (2013.01); *A47L 9/1409* (2013.01);
(Continued)

(58) Field of Classification Search
CPC .... A47L 9/0488; A47L 9/0455; A47L 9/0477; A47L 9/1409; A47L 9/2847;
(Continued)

(56) References Cited

U.S. PATENT DOCUMENTS 4,729,141 A * 3/1988 Berg ..... E01H 1/053 15/49.1
5,802,665 A * 9/1998 Knowlton ..... A47L 11/302 15/340.1
(Continued)

FOREIGN PATENT DOCUMENTS

CN 1720852 A 1/2006
CN 101066198 A 11/2007
(Continued)

OTHER PUBLICATIONS

Chinese Office Action dated Nov. 26, 2021 in a counterpart Chinese patent application.

*Primary Examiner* — David Redding
(74) *Attorney, Agent, or Firm* — Metrolex IP Law Group, PLLC

(57) ABSTRACT

An autonomous traveling floor cleaner is disclosed that improves cleaning efficiency. A floor cleaner may include a suction nozzle that suctions suction matter collected by a rotary brush, an extension nozzle that suctions suction matter collected by an extension brush, and a collection box for collecting, through an inlet, the suction matter suctioned by the nozzles. The floor cleaner may have an elongated profile. The extension nozzle may be switchable between a retracted posture and a lateral cleaning posture. The extension nozzle in the lateral cleaning posture may be pivotable rearward. The extension nozzle in the lateral cleaning posture may have a protruding end in the width direction to be aligned with an end of a turning range of the floor cleaner in the width direction.

9 Claims, 21 Drawing Sheets

(52) U.S. Cl.
CPC ..... *A47L 9/2847* (2013.01); *A47L 9/2852* (2013.01); *A47L 2201/04* (2013.01); *A47L 2201/06* (2013.01)

(58) Field of Classification Search
CPC ..... A47L 9/2852; A47L 2201/04; A47L 2201/06; A47L 11/24; A47L 11/4055; A47L 11/4041; A47L 2201/00; A47L 11/4013; A47L 11/4038; A47L 11/4066; A47L 11/4094
See application file for complete search history.

(56) References Cited

U.S. PATENT DOCUMENTS

| | | | |
|---|---|---|---|
| 2006/0010638 | A1 | 1/2006 | Shimizu et al. |
| 2007/0252549 | A1 | 11/2007 | Cho et al. |
| 2020/0405115 | A1 | 12/2020 | Furuta et al. |

FOREIGN PATENT DOCUMENTS

| | | | | |
|---|---|---|---|---|
| CN | 109982624 | A | | 7/2019 |
| CN | 111031877 | A | | 4/2020 |
| DE | 102018111845 | | * | 11/2019 |
| JP | 2004-337301 | A | | 12/2004 |
| JP | 2005-6857 | A | | 1/2005 |
| JP | 2018-112917 | A | | 7/2018 |

* cited by examiner

AUTONOMOUS TRAVELING CLEANER

CROSS-REFERENCE TO RELATED APPLICATION

This application claims the benefit of priority to Japanese Patent Application No. 2019-218717 filed with Japan Patent Office on Dec. 3, 2019, the contents of which are incorporated herein by reference.

BACKGROUND

The disclosure relates to an autonomous traveling cleaner that travels autonomously, and particularly to an autonomous traveling cleaner including a collection box for collecting suction matter, such as suctioned dust.

Autonomous traveling cleaners are known and called cleaning robots. An autonomous traveling cleaner travels autonomously while cleaning target surfaces such as floor surfaces by suctioning air through its suction nozzle hole that is directed toward the target surfaces and suctioning dust on the surfaces. The suctioned dust (suction matter) is collected into a collection box attached to the cleaner.

Recent labor shortages and increasing labor costs have caused a lack of cleaning personnel who clean wide places, such as concourses at stations or airports and shopping malls. These and other factors have increased the use of industrial autonomous traveling cleaners that are designed to travel autonomously and have high cleaning performance as well as a high degree of safety (refer to Japanese Unexamined Patent Application Publication No. 2018-112917 (Patent Literature 1)). Such autonomous traveling cleaners have collision avoidance for traveling safely without colliding with passersby, obstacles, or walls.

SUMMARY

Such known industrial autonomous traveling cleaners can clean narrow passages, but they travel at a certain distance from wall surfaces in view of safer operations, often leaving uncleaned areas. When cleaning large areas, such cleaners may travel a long distance for a long time, possibly having dead batteries.

One or more aspects are directed to an autonomous traveling cleaner with improved cleaning efficiency.

An autonomous traveling cleaner according to one or more embodiments travels autonomously on a target surface and cleans the target surface. The autonomous traveling cleaner may include a driving force transmitter that transmits, to the target surface, a moving force of the autonomous traveling cleaner in a traveling direction with a body of the autonomous traveling cleaner in a traveling posture, a suction nozzle including a first rotary brush that sweeps the target surface and suctions first suction matter collected by the first rotary brush, an extension nozzle extendable laterally with respect to the traveling direction and including a second rotary brush that sweeps the target surface to suction second suction matter collected by the second rotary brush, and a collection box including an inlet that collects, through the inlet, the first suction matter suctioned by the suction nozzle and the second suction matter suctioned by the extension nozzle. The autonomous traveling cleaner may have an elongated profile having a larger dimension in the traveling direction than in a width direction orthogonal to the traveling direction. The extension nozzle may be switchable between a first posture and a second posture. The extension nozzle in the first posture may be positioned without laterally protruding from the autonomous traveling cleaner and has an airflow path being blocked from the extension nozzle to the collection box. The extension nozzle in the second posture may be positioned to laterally protrude from the autonomous traveling cleaner and has an airflow path forming from the extension nozzle to the collection box. The extension nozzle in the second posture may be pivotable in a direction opposite to the traveling direction. The extension nozzle in the second posture may have a protruding end in the width direction to be aligned with an end of a turning range of the autonomous traveling cleaner in the width direction, when the autonomous traveling cleaner is viewed in the traveling direction.

The autonomous traveling cleaner with the above described structure may have an elongated profile having a smaller width than a depth. The autonomous traveling cleaner may travel and clean along a wall with the extension nozzle out of contact with the wall surface by, for example, keeping a predetermined distance from the wall surface and thus having its turning range excluding the wall surface. The autonomous traveling cleaner may avoid contact of its body with the wall surface when changing the direction (or turning) near the wall. The autonomous traveling cleaner includes the extension nozzle pivotable rearward upon contact with the wall surface when the autonomous traveling cleaner changes the direction near the wall, which avoids damage to the extension nozzle. The autonomous traveling cleaner may have a space for accommodating the functional units and may travel on and clean narrow passageways with improved cleaning efficiency near walls.

In the autonomous traveling cleaner according to one or more embodiments, the protruding end of the extension nozzle may have an arc-shaped corner in the traveling direction in a plan view of the autonomous traveling cleaner. In the autonomous traveling cleaner according to one or more embodiments, the extension nozzle may include a roller on a corner of the protruding end in the traveling direction in a plan view of the autonomous traveling cleaner.

The autonomous traveling cleaner with the above described structure may include the extension nozzle easily pivotable rearward upon contact with a wall surface when the autonomous traveling cleaner changes the direction (or turns), which may effectively avoid damage to the extension nozzle.

The autonomous traveling cleaner according to one or more embodiments may further include a travel controller that controls traveling of the autonomous traveling cleaner. The travel controller causes the autonomous traveling cleaner to travel along a wall surface within the turning range to exclude the wall surface in a plan view of the autonomous traveling cleaner.

The autonomous traveling cleaner with the above described structure may keep a predetermined distance and thus may have its turning range excluding the wall surface. The autonomous traveling cleaner may thus travel and clean near the wall with the extension nozzle out of contact with the wall surface.

In the autonomous traveling cleaner according to one or more embodiments, the extension nozzle may switch from the first posture to the second posture in response to the autonomous traveling cleaner traveling at a preset place on a traveling route.

The autonomous traveling cleaner with the above described structure may have the extension nozzle protruding laterally when, for example, traveling on preset wide passageways or passageways near walls.

The autonomous traveling cleaner according to one or more embodiments may further include a retainer that applies an urging force to the extension nozzle to retain the extension nozzle in the second posture. In response to an external force applied to the extension nozzle, the retainer may cause, against the urging force, the extension nozzle to pivot, from the second posture, in a direction in which the external force is applied, and may return the extension nozzle in the second posture with the urging force in response to the external force removed from the extension nozzle.

The autonomous traveling cleaner with the above described structure may have the extension nozzle protruding laterally to pivot rearward upon contact with an obstacle during autonomous traveling, which may avoid damage to the extension nozzle.

In the autonomous traveling cleaner according to one or more embodiments, the retainer may include a tension coil spring. The tension coil spring may have an end fixed to the extension nozzle. The tension coil spring may apply a tensile force to the extension nozzle to retain the extension nozzle in the second posture.

The above described structure may allow the pivoted extension nozzle to return to and be retained in the second posture.

In the autonomous traveling cleaner according to one or more embodiments, the retainer may retain the extension nozzle tilted opposite to the traveling direction at a predetermined angle with respect to the width direction when the extension nozzle is in the second posture and free from the external force.

The autonomous traveling cleaner with the above described structure may have the extension nozzle that more easily pivots rearward upon contact with a wall surface when changing the direction (turning), which may effectively avoid damage to the extension nozzle.

In the autonomous traveling cleaner according to one or more embodiments, the inlet may include a first inlet in a bottom surface of the collection box, and a second inlet in a side surface of the collection box. The collection box may collect, through the first inlet, the first suction matter suctioned by the suction nozzle and stops collection with the extension nozzle when the extension nozzle is in the first posture. The collection box may collect, through the first inlet, the first suction matter suctioned by the suction nozzle and collects, through the second inlet, the second suction matter suctioned by the extension nozzle when the extension nozzle is in the second posture.

The autonomous traveling cleaner with the above described structure may suction debris with the suction nozzle when the extension nozzle is in the first posture, and may suction debris with the suction nozzle and the extension nozzle when the extension nozzle is in the second posture. The autonomous traveling cleaner may have improved cleaning efficiency The technique according to one or more embodiments may improve cleaning efficiency.

DETAILED DESCRIPTION

One or more embodiments will now be described with reference to the drawings. The embodiments described below are mere examples and should not be construed as limiting the technical scope of the invention. A vertical direction D1, a front-rear direction D2, and a lateral or width direction D3 referred to herein are illustrated in the figures.

Floor Cleaner 10

Figure 1:
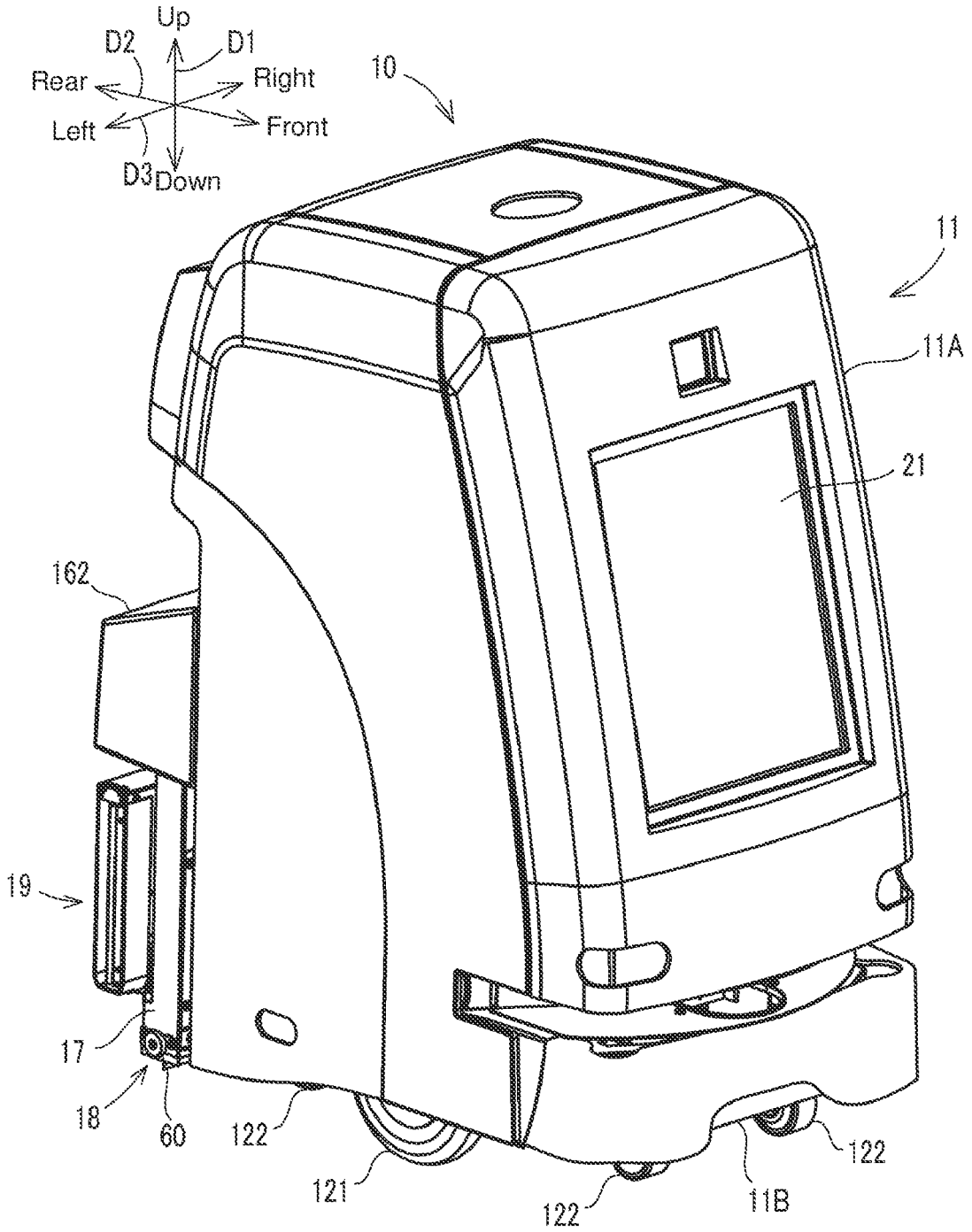
FIG. 1 is a diagram illustrating an external front perspective view of a floor cleaner according to an embodiment or embodiments.

FIG. 1 is a diagram illustrating an external front perspective view of a floor cleaner 10 according to one or more embodiments. The floor cleaner 10 (an example of an autonomous traveling cleaner in an aspect) autonomously travels forward (in a traveling direction) while automatically cleaning a floor surface 23 (a target surface) of a concourse at a facility such as an airport, a station, or a shopping mall. The floor cleaner 10 generates a suction force for suctioning air using, for example, a blower. With the suction force, the floor cleaner 10 suctions debris, such as dirt and dust, from the floor surface together with air. The floor cleaner 10 then separates debris using a filter to collect the debris into a collection box 16 (refer to FIG. 2). The floor cleaner 10 automatically cleans the floor surface 23 while traveling on the floor surface 23 based on various items of cleaning information including traveling routes and cleaning areas that are preliminarily input, the time of day for cleaning, and the home position to which the floor cleaner 10 returns for charging.

The floor cleaner 10 is an example of an autonomous traveling cleaner according to one or more embodiments. Embodiments may also be applicable to, for example, cleaners that clean outdoor surfaces, such as pedestrians and vehicle roads, while traveling autonomously.

Figure 2:
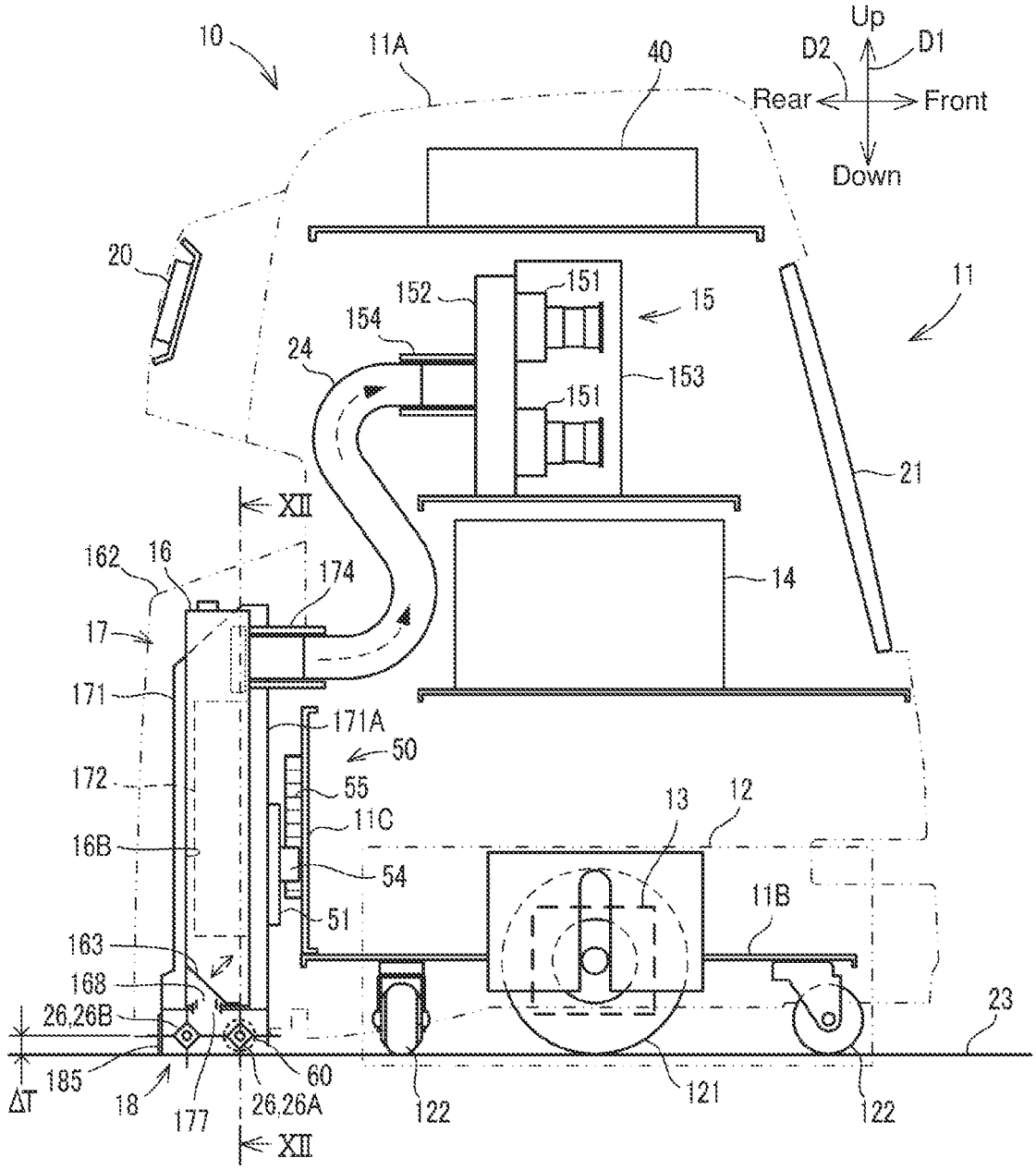
FIG. 2 is a schematic diagram illustrating a floor cleaner.

FIG. 2 is a schematic diagram illustrating the floor cleaner 10. As shown in FIGS. 1 and 2, the floor cleaner 10 includes a body 11 and functional units included in the body 11. More specifically, the body 11 includes a traveling assembly 12 (an example of a driving force transmitter in an aspect), motors 13, a battery 14, a suction unit 15, a collection box 16 (an example of a collection box in an aspect), a support holder 17, a suction nozzle 18 (an example of a suction nozzle in an aspect), an extension nozzle 19 (an example of an extension nozzle in an aspect), an operation unit 20, a display panel 21, a holder movement assembly 50, and a control unit 40.

As shown in FIG. 1, the body 11 includes an exterior cover 11A defining the exterior of the body 11. As shown in FIG. 2, the body 11 includes a chassis 11B in its lower portion. The chassis 11B is located substantially parallel to the floor surface 23. The body 11 includes a support frame for supporting the above functional units as appropriate.

As shown in FIG. 2, the body 11 includes the traveling assembly 12 in its lower portion. The traveling assembly 12, which is attached to the chassis 11B, maintains the traveling posture of the body 11 and transmits the moving force of the body 11 in the traveling direction to the floor surface 23. The traveling assembly 12 includes a pair of traveling wheels 121 and four casters 122.

The wheels 121 are rotatably supported in the middle of the chassis 11B in the front-rear direction and at the two ends of the chassis 11B in the width direction D3. The four casters 122 maintain the traveling posture of the body 11 and are rotatably supported at two front ends and two rear ends of the chassis 11B. When the floor cleaner 10 is located on the floor surface 23, the floor surface 23 supports the outer peripheral surfaces of the wheels 121 and the casters 122. The body 11 is thus maintained in the traveling posture shown in FIGS. 1 and 2.

Each wheel 121 includes a rotational shaft connected to an output shaft of the motor 13 through a transmission such as a reduction gear. When the motor 13 is driven to output a rotational driving force from the output shaft, the rotational driving force of the motor 13 is transmitted to the corresponding wheel 121. In a present embodiment, the motor 13 is located separately for each of the pair of wheels 121. Thus, driving of each motor 13 is individually controlled to control the rotational speed of the corresponding wheel 121. When, for example, the rotational speed of each wheel 121 is controlled at the same speed, the floor cleaner 10 travels straight. When the rotational speed of each wheel 121 is controlled at a different speed, the floor cleaner 10 turns on the wheel 121 with a lower rotational speed.

The suction unit 15 is located above the battery 14 (described later) inside the body 11. The suction unit 15 generates a suction force for suctioning air through the suction nozzle 18 (described later). The suction unit 15 includes multiple suction fans 151 (blowers), a suction manifold 152, and an exhaust manifold 153. The suction manifold 152 includes three suction ports 154 that align with one another in the width direction D3. The suction ports 154 each receive a corresponding flexible hose 24 for suctioning air. The exhaust manifold 153 receives one end of an exhaust duct (not shown). The other end of the exhaust duct is connected to the chassis 11B, and has an outlet located in a space between the chassis 11B and the floor surface 23. The suction fans 151 are driven to draw air through inlets at distal ends of the flexible hoses 24. The air passes through the flexible hoses 24, the suction manifold 152, the suction fans 151, the exhaust manifold 153, and the exhaust duct, and is then discharged outside through the outlet.

The battery 14 is located in a central portion of the body 11. The battery 14 supplies power for driving the motors 13 and the suction fans 151. The battery 14 also supplies driving power to a motor 62 (refer to FIG. 9) for rotationally driving rotary brushes 26 (described later), a motor 30 (refer to FIG. 14) for rotationally driving the extension nozzle 19 (described later), and a motor 19C (refer to FIG. 15) for rotationally driving an extension brush 19A (described later). The battery 14 also supplies driving power to a motor 56 (refer to FIG. 9) for raising and lowering the holder movement assembly 50 (described later).

As shown in FIG. 2, the collection box 16 is located on a back surface of the body 11. The collection box 16 attached to the body 11 is covered with a cover 162. The body 11 includes, on its back surface, the support holder 17 for holding the collection box 16 in a detachable manner. The collection box 16 is attached to the support holder 17 in a detachable manner. The cover 162 is attached to the support holder 17.

The support holder 17 has three suction ports 174. The suction ports 174 extend through the front surface of the support holder 17 to an exhaust port of the collection box 16. Each suction port 174 receives an end of the corresponding flexible hose 24. The support holder 17 includes the suction nozzle 18 in its lower portion and the extension nozzle 19 in its side portion. The nozzles 18 and 19 communicate with the collection box 16. The suction unit 15 is driven to draw air with the suction nozzle 18 and the extension nozzle 19, which flows through the collection box 16 into the flexible hoses 24. The collection box 16, the support holder 17, and the suction nozzle 18 will be described in detail later.

Figure 3:
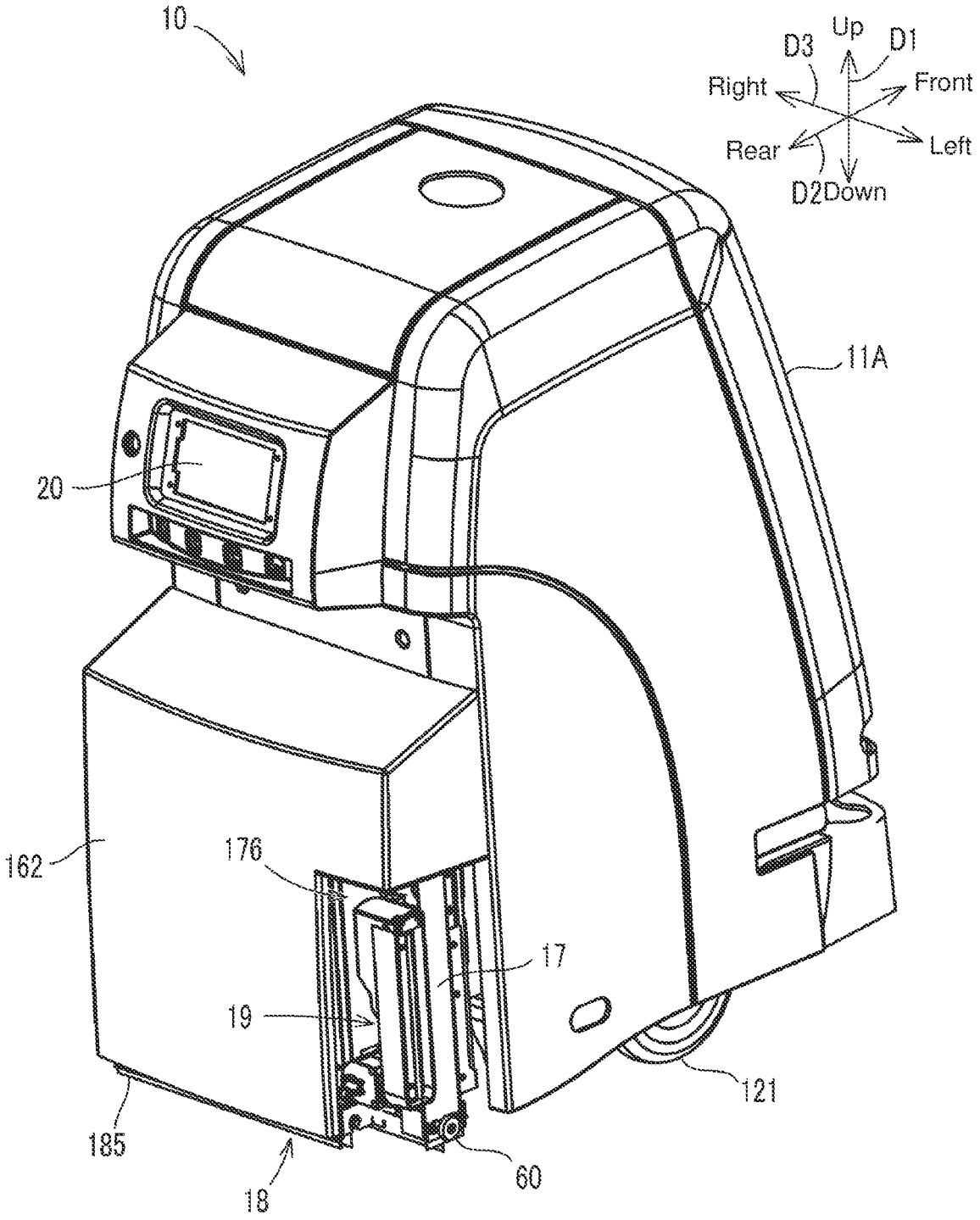
FIG. 3 is a diagram illustrating an external rear perspective view of a floor cleaner having an extension nozzle in a retracted posture.
Figure 4:
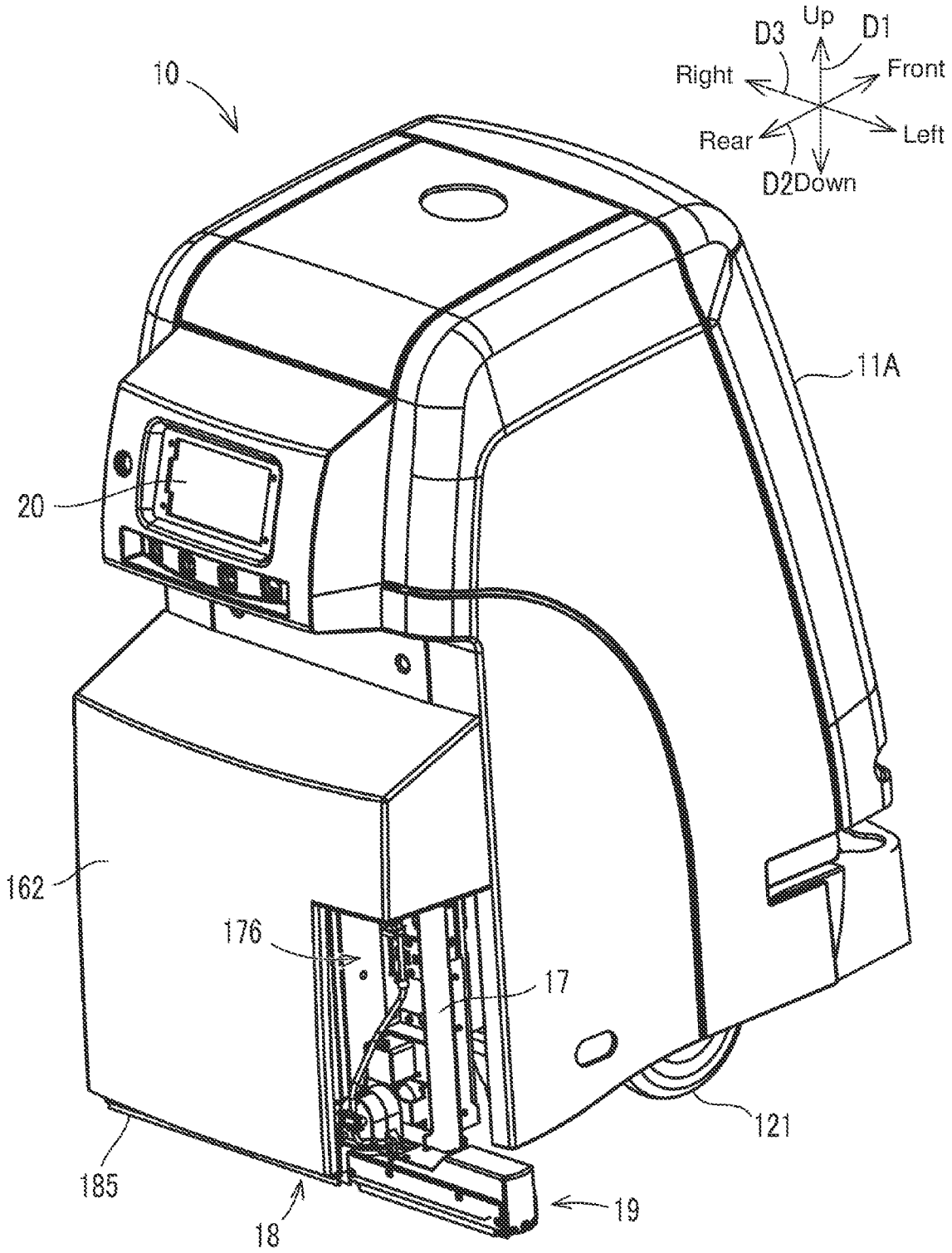
FIG. 4 is a diagram illustrating an external rear perspective view of a floor cleaner having the extension nozzle in a lateral cleaning posture.
Figure 7:
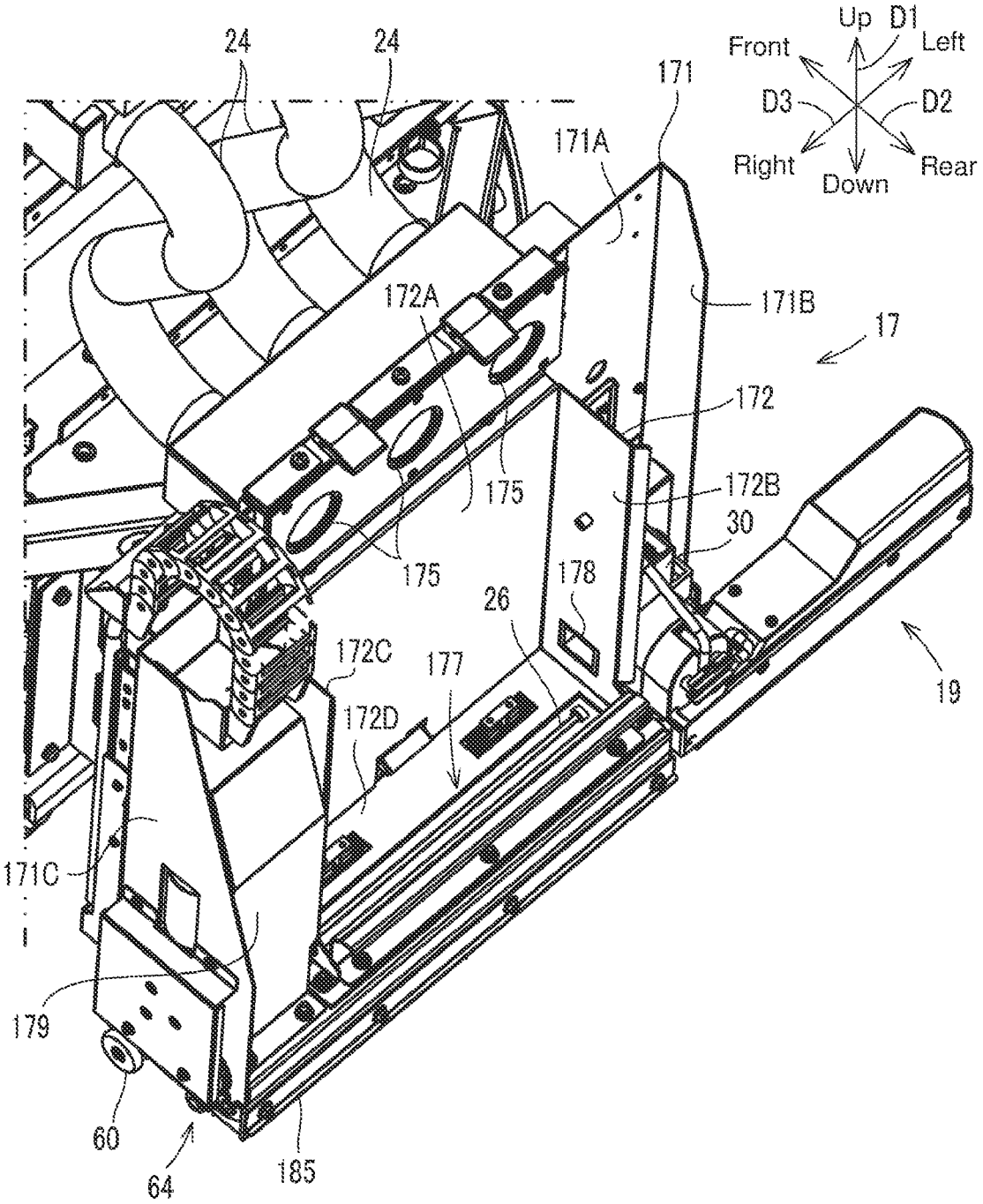
FIG. 7 is a diagram illustrating a perspective view of a support holder included in a floor cleaner.

FIGS. 3 and 4 are diagrams illustrating external rear perspective views of the floor cleaner 10. As shown in FIGS. 3 and 4, the extension nozzle 19 is located in a left portion of the support holder 17. The support holder 17 includes, on its left, a compartment 176 (described later) that can accommodate the extension nozzle 19. The extension nozzle 19 is supported by the support holder 17. More specifically, the extension nozzle 19 is supported by the support holder 17 in a manner switchable between a retracted posture (an example of a first posture in an aspect) and a lateral cleaning posture (an example of a second posture in an aspect). In the retracted posture, the extension nozzle 19 is retracted in the compartment 176 as shown in FIGS. 1 and 3. In the lateral cleaning posture, the extension nozzle 19 is turned leftward (laterally) from inside the compartment 176 to lie on its side, as shown in FIGS. 4 and 7, to clean the floor surface 23 on the left of the body 11. In a present embodiment, the extension nozzle 19 is supported in a manner pivotable between the retracted posture and the lateral cleaning posture about a pivot shaft near the lower end of the support holder 17. FIG. 3 shows the extension nozzle 19 in the retracted posture. FIG. 4 shows the extension nozzle 19 in the lateral cleaning posture. The extension nozzle 19 will be described in detail later.

The operation unit 20 is located on an upper back surface of the body 11. The operation unit 20 is attached to the exterior cover 11A. The operation unit 20 is operable by an operator, and is, for example, a terminal device with a touchscreen operable by touch. The operation unit 20 can receive input of various items of information for the floor cleaner 10, including information about traveling routes, cleaning areas, the time of day for cleaning, and the home position. The input cleaning information is transferred to the control unit 40 and used for traveling control by the control unit 40.

The display panel 21 is located on a front surface of the body 11. The display panel 21 is, for example, a liquid crystal display panel. Various messages are displayed on the display panel 21 by the control unit 40 during cleaning. These messages include a cleaning status message indicating cleaning currently being performed or a guidance message about a floor currently being cleaned.

The holder movement assembly 50 is located inside the body 11 on the back surface of the body 11 as shown in FIG. 2. The holder movement assembly 50 supports the support holder 17 in a manner movable in the vertical direction D1, and transmits a driving force to move the support holder 17 in the vertical direction D1. In a present embodiment, in response to a maintenance instruction from the operation unit 20, the control unit 40 controls the motor 56 to raise the support holder 17 from a cleaning position (initial position) to a maintenance position. The control unit 40 then causes the support holder 17 to be held at the maintenance position. In response to a signal indicating completion of maintenance, the control unit 40 controls the motor 56 to lower the support holder 17 to the cleaning position. When the remaining battery level decreases below a threshold, the floor cleaner 10 returns to the home position, and the control unit 40 controls the motor 56 to raise the support holder 17 to a charging position. When the support holder 17 is at the charging position, the floor cleaner 10 is connected to a charger (not shown) to start charging the battery 14.

The control unit 40 is located in an upper portion of the body 11. The control unit 40 controls operations including traveling of the floor cleaner 10, driving of the suction fans 151 of the suction unit 15, driving of the rotary brushes 26 and the extension brush 19A, driving of the extension nozzle 19, raising and lowering of the support holder 17 with the holder movement assembly 50, and displaying on the display panel 21. The control unit 40 includes control devices such as a central processing unit (CPU), a read-only memory (ROM), and a random-access memory (RAM), and a storage medium or device such as a hard disk drive (HDD) and a flash memory. The CPU is a processor for performing various computations. The ROM is a non-volatile memory prestoring control programs, such as a basic input-output system (BIOS) and an operating system (OS), for causing the CPU to perform various processes. The RAM is a volatile or non-volatile memory for storing various items of information, and is used as a memory area (work area) for temporarily storing various processes to be performed by the CPU. The control unit 40 causes the CPU to execute various control programs prestored in the ROM or storage device to control operations including traveling of the floor cleaner 10, driving of the suction fans 151, driving of the rotary brushes 26 and the extension brush 19A, driving of the extension nozzle 19, and raising and lowering of the support holder 17.

Support Holder 17

Figure 5:
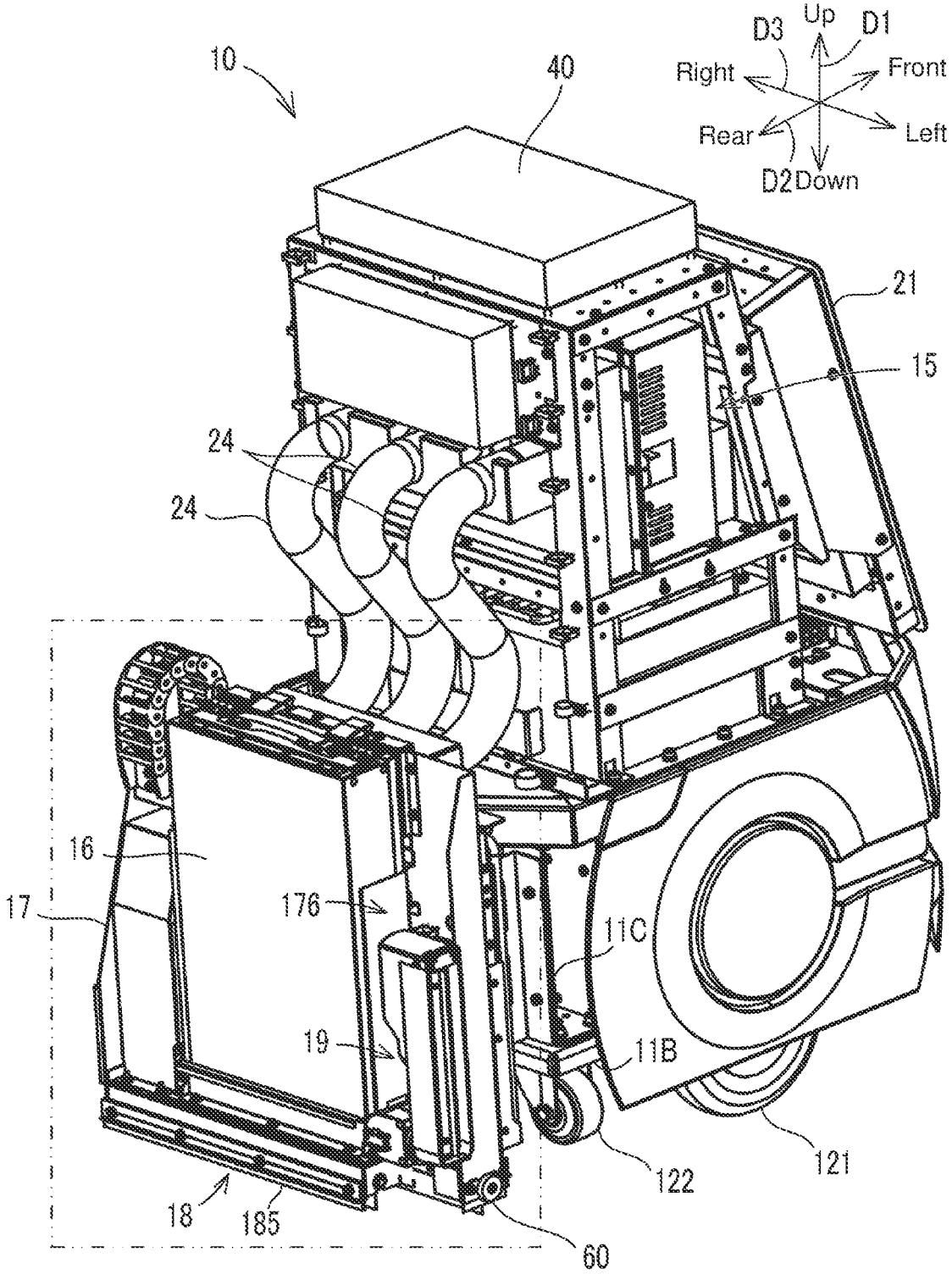
FIG. 5 is a diagram illustrating a perspective view of a floor cleaner showing an internal structure.
Figure 6:
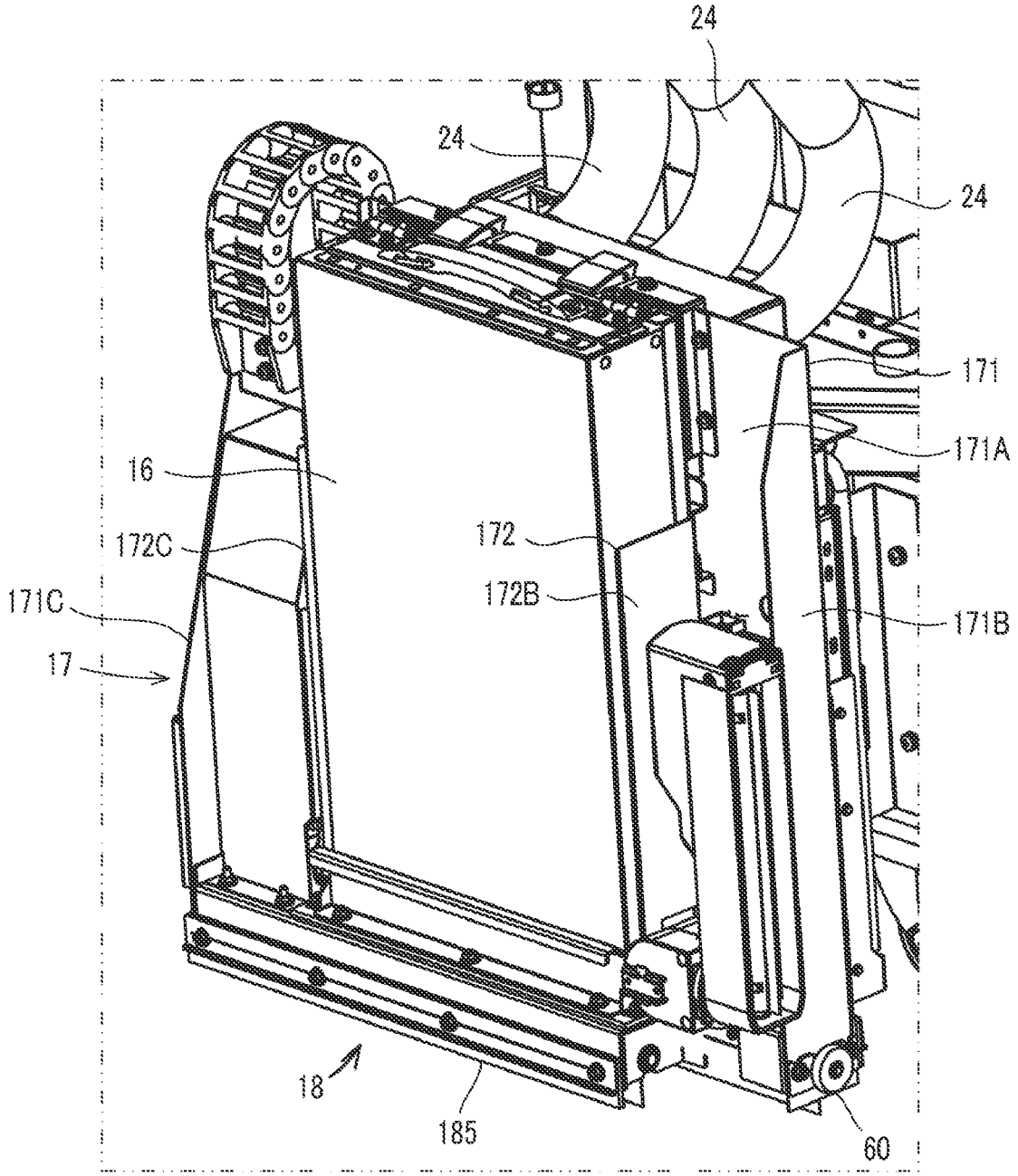
FIG. 6 is a diagram illustrating an enlarged view of a main part VI in FIG. 5.

FIGS. 5 and 6 are diagrams illustrating perspective views of the floor cleaner 10 without the exterior cover 11A. As shown in FIGS. 5 and 6, the support holder 17 is located on the back surface of the floor cleaner 10. The body 11 contains a plate-like vertical frame 11C extending upward from the rear end of the chassis 11B. The support holder 17 is attached to the vertical frame 11C. In a present embodiment, the support holder 17 is supported by the vertical frame 11C of the body 11 in a manner movable in the vertical direction D1, as described later.

FIG. 7 is a diagram illustrating a perspective view of the support holder 17. As shown in FIG. 7, the support holder 17 includes a base 171 extending in the vertical direction D1, and a box compartment 172 fastened to the base 171.

The base 171 is formed by bending a metal plate. The base 171 includes a base plate 171A attached to the vertical frame 11C, and side plates 171B and 171C protruding rearward from the two ends of the base plate 171A in the width direction D3. The base plate 171A receives, at its upper end, three suction ports 174 (refer to FIG. 2) for receiving the ends of the flexible hoses 24. Each suction port 174 is a cylinder protruding frontward from the base plate 171A.

The base plate 171A has three communicating holes 175 at the upper end in the rear surface of the base plate 171A. The communicating holes 175 align with the suction ports 174. When the collection box 16 is attached to the box compartment 172, outlet ports 167 (refer to FIG. 9) in a side surface of the collection box 16 communicate with the communicating holes 175, which connects the flexible hoses 24 to the collection box 16 for suction from the collection box 16.

The collection box 16 contains an air filter 169 (refer to FIG. 9) for filtering debris, such as dust, out of air discharged from the outlet ports 167 to purify the air. Examples of the air filter 169 include a chemical filter, a high-efficiency particulate air (HEPA) filter, and an ultra-low particulate air (ULPA) filter.

The box compartment 172 supports the collection box 16 in a detachable manner. The box compartment 172 is fastened to the rear surface of the base 171, and is located at the center of the base 171 in the width direction D3. The box compartment 172 is formed by bending a metal plate. The box compartment 172 includes an attachment plate 172A fastened to the base 171, and side plates 172B and 172C protruding rearward from the two ends of the attachment plate 172A in the width direction D3. The box compartment 172, which is shorter than the base 171 in the width direction D3, is retracted in a space defined by the side plates 171B and 171C of the base 171, as shown in FIG. 7.

Figure 8A:
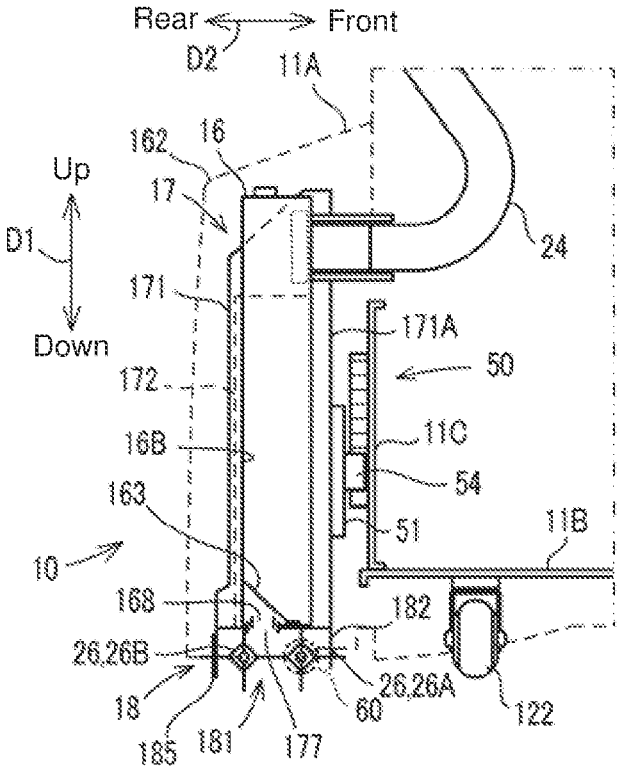
FIG. 8A is a diagram illustrating a side view of a rear portion of a floor cleaner with a collection box attached to the floor cleaner.
Figure 8B:
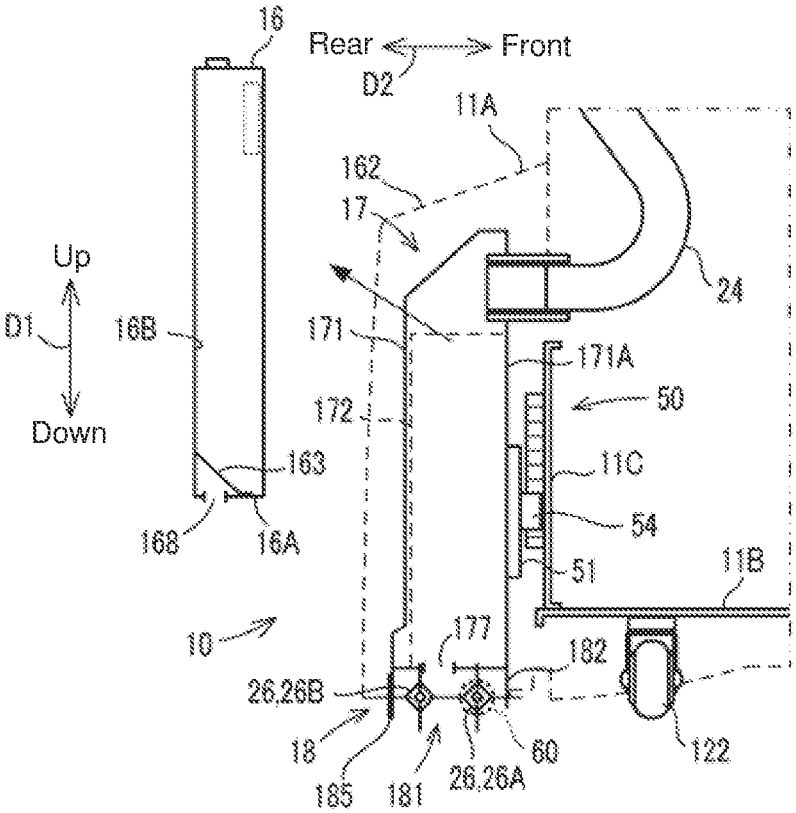
FIG. 8B is a diagram illustrating a side view of the rear portion of a floor cleaner with the collection box detached from the floor cleaner.

As shown in FIG. 7, the box compartment 172 is open rearward and upward. As shown in FIGS. 8A and 8B, the collection box 16 can be lifted diagonally rearward and upward from the box compartment 172 when a door (not shown) on the cover 162 is open, which allows easy detachment of the collection box 16 from the box compartment 172. FIG. 8A is a side view of a rear portion of the floor cleaner 10 with the collection box 16 attached to the box compartment 172. FIG. 8B is a side view of the rear portion of the floor cleaner 10 with the collection box 16 detached from the box compartment 172.

As shown in FIG. 7, the box compartment 172 includes a bottom surface 172D having a rectangular opening 177 elongated in the width direction D3. The opening 177 communicates with the suction nozzle 18 (described later). When the collection box 16 is attached to the box compartment 172, an inlet 168 (refer to FIGS. 8B and 11) (an example of a first inlet in an aspect) in a bottom surface 16A of the collection box 16 aligns with the opening 177, which allows the collection box 16 to communicate with the suction nozzle 18 to collect, through the inlet 168, dust (an example of first suction matter in an aspect) suctioned by the suction nozzle 18 together with air. When the collection box 16 is detached from the box compartment 172, the rotary brushes 26 are exposed and can be visually checked from vertically above.

The box compartment 172 has an opening 178 (refer to FIG. 7) in a lower portion of the left side plate 172B. The opening 178 communicates with the extension nozzle 19. When the collection box 16 is attached to the box compartment 172, a side inlet 161 (refer to FIG. 11) (an example of a second inlet in an aspect) in a lateral side surface 16C of the collection box 16 aligns with the opening 178, which allows the collection box 16 to communicate with the extension nozzle 19 to collect, through the side inlet 161, dust (an example of second suction matter in an aspect) suctioned by the extension nozzle 19 together with air.

Collection Box 16

Figure 11:
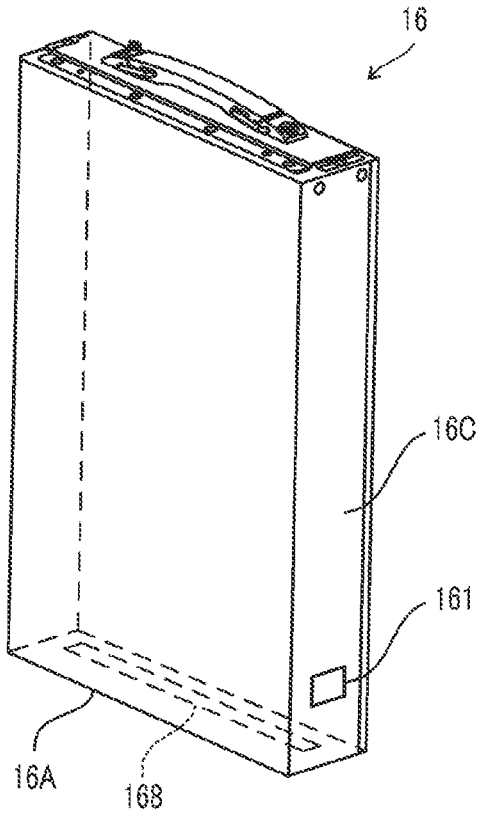
FIG. 11 is a diagram illustrating a perspective view of the collection box included in a floor cleaner.

The collection box 16, which may be a hollow box, can collect debris such as dust (suction matter) suctioned through a suction hole 181 (refer to FIG. 8) of the suction nozzle 18 (described later). As shown in FIGS. 6 and 11, the collection box 16 is shaped in a rectangle that is thinner in the front-rear direction D2. As shown in FIG. 8, the collection box 16 contains a sheet flap 163 for opening and closing the inlet 168. The flap 163 is formed from an elastic synthetic resin, such as a PET resin.

The flap 163 has a front end fixed to the bottom surface 16A of the collection box 16, and extends diagonally rearward and upward from the fixed front end. The flap 163 has an extended end in contact with a rear side surface 16B of the collection box 16. The extended end of the flap 163 may be a free end pivotable about the fixed end of the flap 163.

With no air suction being performed, the flap 163 is urged toward the side surface 16B by its elasticity. The flap 163 has its extended end in contact with the side surface 16B to cover the inlet 168, without the debris in the collection box 16 dropping outside through the inlet 168. When the collection box 16 is detached from the box compartment 172, the flap 163 covers the inlet 168, without the debris dropping outside through the inlet 168.

With air suction being performed by driving the suction fans 151, the collection box 16 has a negative pressure that causes air to flow in through the inlet 168. Such air inflow causes the flap 163 to flex forward against the urging force toward the side surface 16B. The flap 163 then no longer covers the inlet 168, allowing smooth air suction through the inlet 168 into the collection box 16. When the suction fans 151 stop being driven, the flap 163 returns to its original position to cover the inlet 168 again.

Figure 10:
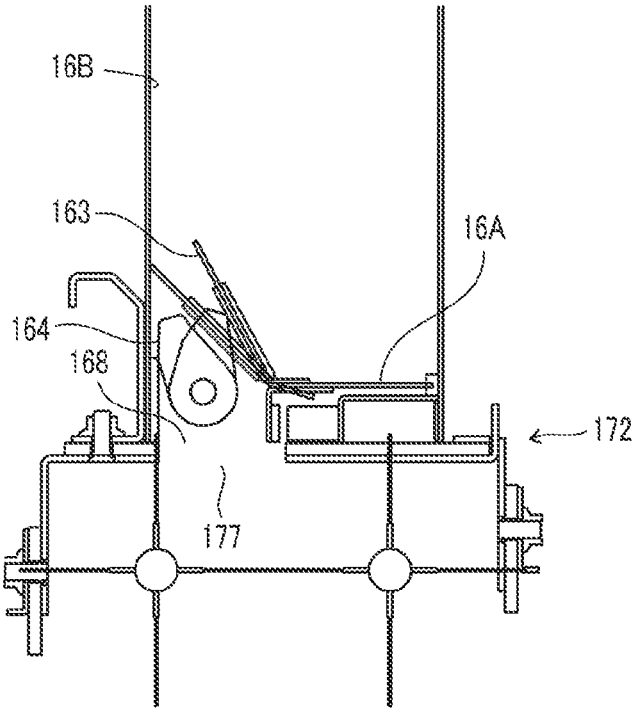
FIG. 10 is a diagram illustrating a view of an open-close assembly for a flap included in a floor cleaner.

In some embodiments, the flap 163 may be driven as controlled by the control unit 40. As shown in FIG. 10, for example, a solenoid 164 may be located below the flap 163. The solenoid 164 is pivotably supported by the support holder 17 and protrudes upward from the opening 177 in the box compartment 172. When the collection box 16 is attached to the box compartment 172, the upper end of the solenoid 164 is in contact with the lower surface of the flap 163. The control unit 40 drives the suction fans 151 and applies a predetermined driving force (current) to the solenoid 164, which causes the solenoid 164 to pivot and push up the flap 163, uncovering the inlet 168. When the control unit 40 stops driving the suction fans 151 and the solenoid 164, the solenoid 164 returns to its original position to cause the flap 163 to cover the inlet 168 again.

Suction Nozzle 18

As shown in FIG. 8, the suction nozzle 18 suctions debris, such as dust, together with air from the floor surface 23 when the suction fans 151 are operating. The suction nozzle 18 has the suction hole 181 above the floor surface 23 with a predetermined clearance ΔT between the suction hole 181 and the floor surface 23. In other words, the suction hole 181 is above away from the floor surface 23 with the clearance ΔT between them. The suction nozzle 18 is located at the lower end of the support holder 17. In a present embodiment, the suction nozzle 18 is integral with the box compartment 172 of the support holder 17.

The suction nozzle 18, which is elongated in the width direction D3, is defined by a rectangular outer peripheral wall 182 protruding downward from the outer periphery of the bottom surface 172D of the box compartment 172. Thus, the suction nozzle 18 and the box compartment 172 are vertically separated from each other by the bottom surface 172D (refer to FIG. 7). In other words, the collection box 16 and the box compartment 172 supporting the collection box 16 are located vertically above the suction nozzle 18. The outer peripheral wall 182 is open downward to define the suction hole 181 described above.

The suction nozzle 18 includes an elastic sealing sheet 185 located at the rear edge of the suction hole 181 and extending to the floor surface 23. The sealing sheet 185 is shaped in a rectangle elongated in the width direction D3 and bonded to the entire area of the suction hole 181 in the width direction D3. The sealing sheet 185 seals the clearance ΔT between the rear edge of the suction hole 181 and the floor surface 23.

The suction nozzle 18 includes a pair of rotatable rotary brushes 26 (26A and 26B). The rotary brushes 26 correspond to a first rotary brush in an aspect. The rotary brushes 26 align with each other in the front-rear direction D2. Each rotary brush 26 has a rotational shaft 261 (refer to FIG. 9) extending through and rotatably supported by side plates 184 (refer to FIG. 9) at the two ends of the suction nozzle 18 in the width direction D3. Although the suction nozzle 18 in a present embodiment includes the pair of rotary brushes 26, the suction nozzle 18 may include one or three or more rotary brushes 26, instead of the pair of (two) rotary brushes 26.

Figure 9:
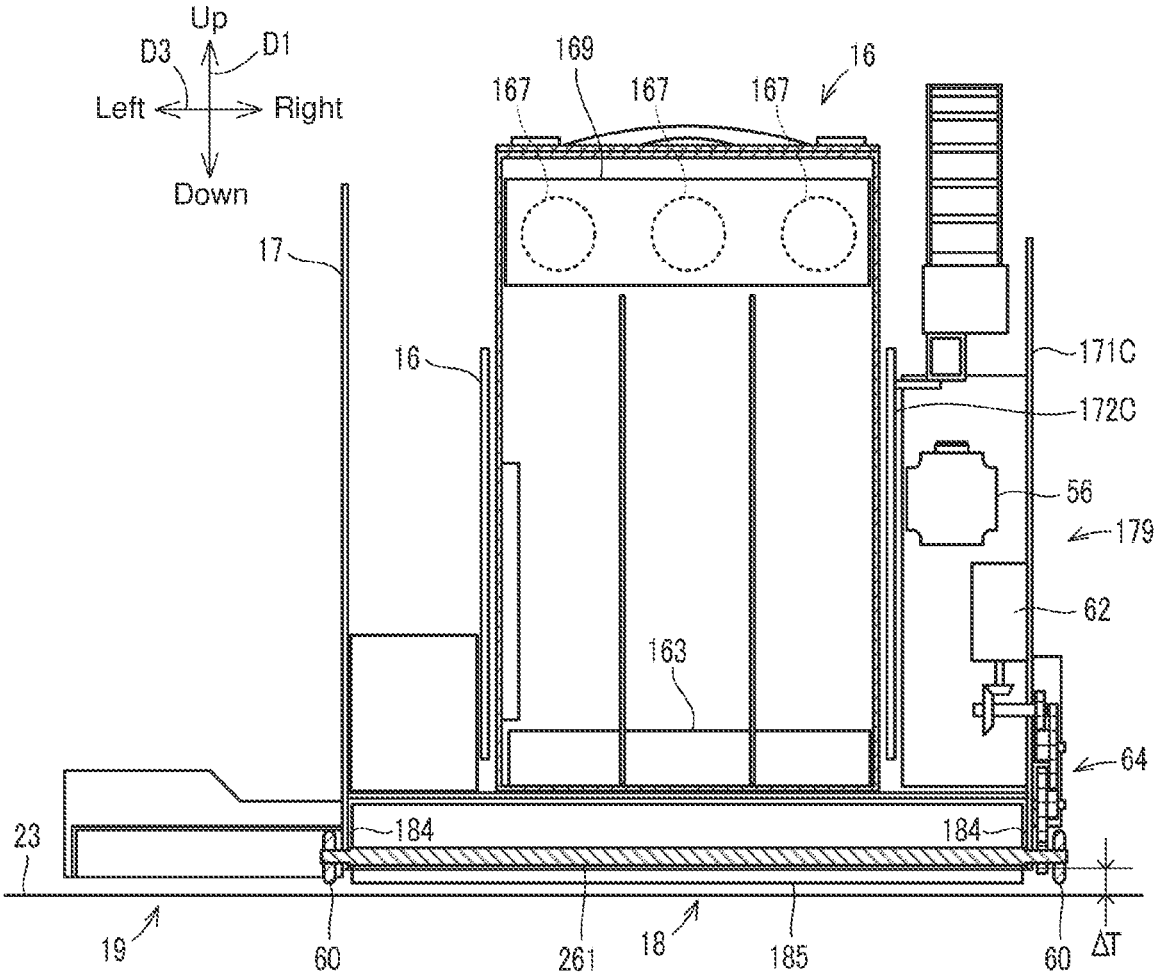
FIG. 9 is a diagram illustrating a schematic cross-sectional view taken along line XII-XII in FIG. 2.

As shown in FIG. 9, the support holder 17 includes the motor 62 for supplying a driving force to the rotary brushes 26. FIG. 9 is a schematic cross-sectional view taken along line XII-XII in FIG. 2. The motor 62 is accommodated in a compartment 179 between the side plate 172C and the side plate 171C. The rotational driving force of the motor 62 is transmitted to the rotational shaft 261 through a transmission 64 including multiple gears. The motor 62 is driven by the control unit 40 during traveling of the floor cleaner 10 to rotate the rotary brushes 26, thus efficiently collecting debris from the floor surface 23.

The front rotary brush 26A of the pair of rotary brushes 26 has rollers 60 rotatably supported on the rotational shaft 261 of the rotary brush 26A. The rollers 60 are attached to the two ends of the rotational shaft 261. More specifically, as shown in FIG. 9, the rollers 60 are attached to the two ends of the rotational shaft 261 protruding outward from the side plates 184 of the suction nozzle 18 in the width direction D3.

The rollers 60 are supported by the support holder 17 to have circumferences between the edge of the suction hole 181 and the floor surface 23. In other words, as shown in FIG. 9, when the floor cleaner 10 is in the traveling posture shown in FIG. 1, the rollers 60 protrude downward from the edge of the suction hole 181 but are not in contact with the floor surface 23.

The collection box 16 is attached to the support holder 17 in a detachable manner, as described above. More specifically, the collection box 16 is placed on and attached to the bottom surface 172D (refer to FIG. 7) of the box compartment 172. Thus, the inlet 168 (refer to FIG. 11) in the bottom surface 16A of the collection box 16 directly communicates with the opening 177 in the bottom surface 172D of the box compartment 172. The suction nozzle 18 is located vertically below the opening 177, and includes the rotary brushes 26. Thus, the collection box 16 is located vertically above the rotary brushes 26 with the opening 177 between the collection box 16 and the rotary brushes 26. With the above described structure, debris swept and collected by the rotary brushes 26 is suctioned by the suction nozzle 18 vertically upward together with air, passes through the opening 177 and the inlet 168, and is directly collected into the collection box 16. The inlet 168 of the collection box 16 faces the rotary brushes 26.

In a present embodiment, the inlet 168 of the collection box 16 is located vertically above (immediately above) and faces the rotary brushes 26, which allows the rotary brushes 26 to be exposed through the opening 177 when the collection box 16 is detached from the box compartment 172, as shown in FIG. 7. Accordingly, the user may easily visually check the rotary brushes 26 from above to determine the state of the rotary brushes 26. When, for example, the rotary brushes 26 become dirty with debris or have any failure, the user can detach the collection box 16 from the box compartment 172 for easy maintenance of the rotary brushes 26. The user can thus easily access the rotary brushes 26, improving the maintainability of the rotary brushes 26.

In a present embodiment, the inlet 168 of the collection box 16 directly communicates with the suction nozzle 18, which allows debris suctioned by the suction nozzle 18 together with air to be directly collected into the collection box 16 without a pipe enabling clogging with debris moving through the suction nozzle 18 to the collection box 16 to be eliminated. The above described structure also shortens the distance by which debris moves, thus improving suction efficiency.

In some embodiments, the inlet 168 may be in a front or rear side surface of the collection box 16 and may laterally face the rotary brushes 26, which allows the user to visually check the rotary brushes 26 from the lateral side when the collection box 16 is detached from the box compartment 172, allowing maintenance of the rotary brushes 26.

Extension Nozzle 19

To minimize the turning range in turning motion, a known floor cleaner is designed to turn about the center of its casing, and has a circular profile in a plan view (as viewed from above). Such a floor cleaner tends to have a larger circular profile to provide a space (accommodating space) for functional units (e.g., a battery) included in the body. When, for example, the floor cleaner has the casing wider than a passageway in the width direction orthogonal to the traveling direction, the floor cleaner may fail to pass through and clean the passageway.

To provide the accommodating space and also travel on narrow passageways, the floor cleaner may have an elongated profile with a depth W2 larger than a width W1 in a plan view. The floor cleaner having such an elongated profile provides a space for accommodating the functional units, and can also travel on and clean narrow passageways. However, the floor cleaner having such an elongated profile may have some difficulties below.

Figure 12:
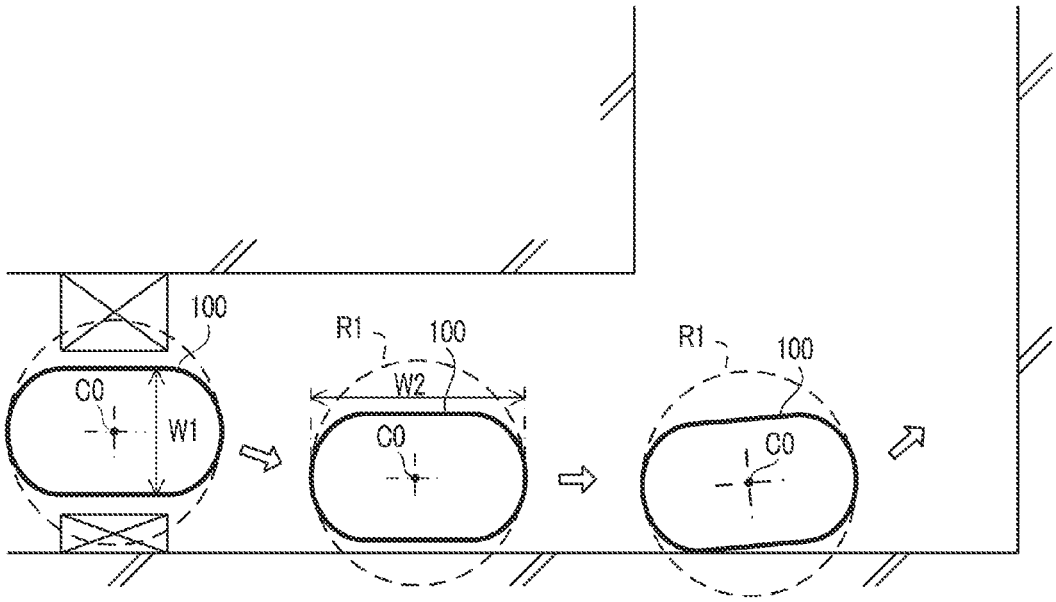
FIG. 12 is a schematic diagram illustrating a floor cleaner illustrating the travel thereof according to a reference embodiment.

FIG. 12 is a schematic diagram illustrating a floor cleaner 100 having an elongated profile illustrating its travel according to one or more exemplary embodiments. FIG. 12 shows the floor cleaner 100 passing through a narrow passageway, then traveling and cleaning near a wall, and then changing its traveling direction (turning) upward in FIG. 12. When changing the direction, the floor cleaner 100 turns about a rotation center C0 (rotation axis). FIG. 12 shows a turning range R1 of the floor cleaner 100. When traveling near the wall and turning, as shown in FIG. 12, the floor cleaner 100 may have its rear end (right rear end in FIG. 12) in contact with the wall surface, and cannot turn properly. To avoid contact with the wall surface, the floor cleaner 100 repeatedly turns left gently while traveling forward and turns right while traveling rearward (three-point turn). The floor cleaner 100 thus takes a long time for cleaning, decreasing cleaning efficiency.

In contrast, the floor cleaner 10 according to a present embodiment has an elongated profile in a plan view, and includes the extension nozzle 19 extendable in the lateral direction with respect to the traveling direction and pivotable rearward. The floor cleaner 10 thus has a space for accommodating the functional units, can travel on and clean narrow passageways, and also has improved cleaning efficiency near walls. The structure of the extension nozzle 19 will now be described in detail.

When the floor cleaner 10 travels at a preset place (passageway) on a traveling route, the extension nozzle 19 switches from the retracted posture to the lateral cleaning posture. When, for example, the floor cleaner 10 travels on a wide passageway or a passageway near a wall, the extension nozzle 19 switches from the retracted posture to the lateral cleaning posture. The control unit 40 obtains information about the current position of the floor cleaner 10. When the current position matches the preset place, the control unit 40 outputs, to the motor 30 (refer to FIGS. 7, 14, and 15), a first control signal (drive signal) for switching the extension nozzle 19 from the retracted posture to the lateral cleaning posture. The motor 30 then generates a driving force in accordance with the first control signal to rotationally drive and switch the extension nozzle 19 to the lateral cleaning posture. When the current position of the floor cleaner 10 is away from the preset place, the control unit 40 outputs, to the motor 30, a second control signal (drive signal) for switching the extension nozzle 19 from the lateral cleaning posture to the retracted posture. The motor 30 then generates a driving force in accordance with the second control signal to rotationally drive and switch the extension nozzle 19 to the retracted posture.

The control unit 40 may control the posture of the extension nozzle 19 based on the detection result from a sensor (not shown) included in the floor cleaner 10. For example, in response to the sensor detecting a passageway width larger than a predetermined width or detecting a wall, the control unit 40 outputs the first control signal. In response to the sensor detecting a passageway width not larger than the predetermined width or detecting an obstacle, the control unit 40 outputs the second control signal.

Figure 13A:
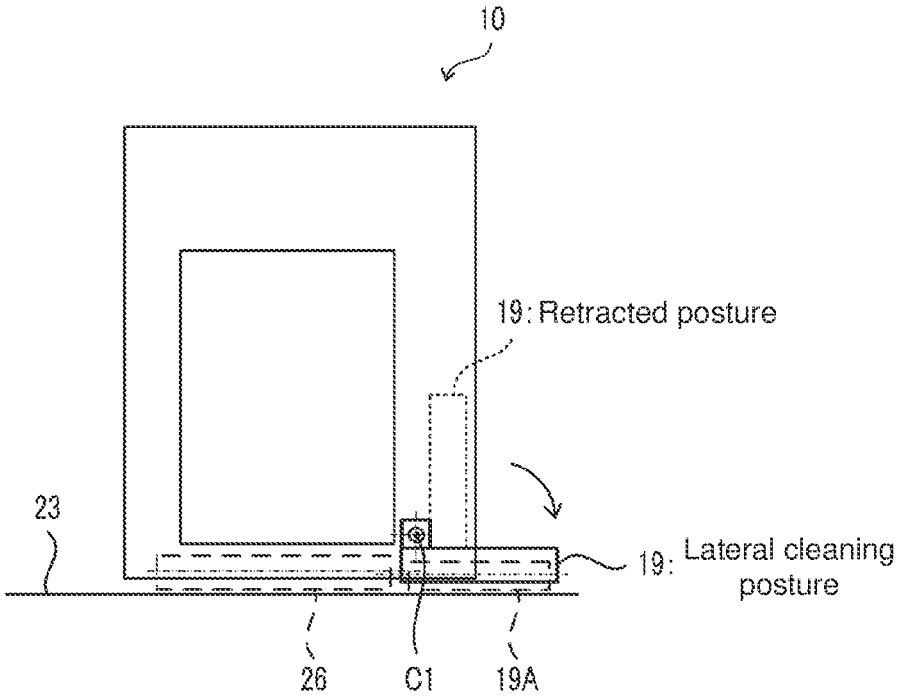
FIG. 13A is a schematic diagram illustrating a floor cleaner as viewed from behind illustrating a posture change of the extension nozzle included in a floor cleaner.

FIG. 13A is a schematic diagram illustrating the extension nozzle 19 switching from the retracted posture to the lateral cleaning posture. In response to the first control signal, the extension nozzle 19 switches to the lateral cleaning posture by pivoting about a pivot shaft C1 toward the floor surface 23. The floor cleaner 10 including the extension nozzle 19 can clean narrow passageways when the extension nozzle 19 is in the retracted posture, and can clean a wider area using the rotary brushes 26 (first rotary brushes in an aspect) and the extension brush 19A (a second rotary brush in an aspect) when the extension nozzle 19 is in the lateral cleaning posture.

Figure 13B:
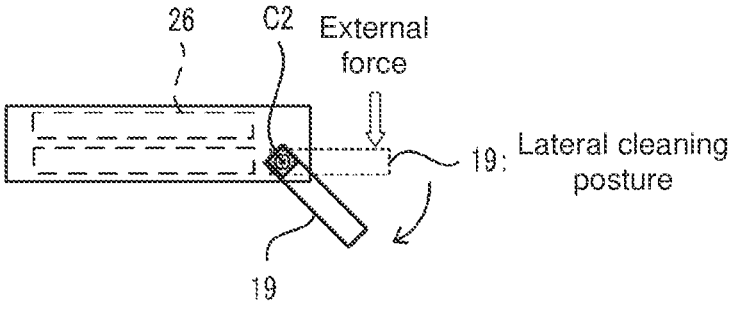
FIG. 13B is a schematic diagram illustrating a floor cleaner as viewed from above illustrating the posture change of the extension nozzle included in a floor cleaner.

The extension nozzle 19 is also supported in a manner pivotable from the lateral cleaning posture rearward with respect to the traveling direction. As shown in FIG. 13B, for example, the extension nozzle 19 pivots rearward about a pivot shaft C2 upon contact with an obstacle, a wall, or other objects when the floor cleaner 10 is traveling with the extension nozzle 19 in the lateral cleaning posture, which avoids damage to the extension nozzle 19. When the floor cleaner 10 passes or moves away from the obstacle, the extension nozzle 19 pivots forward about the pivot shaft C2 to return to its original position.

Figure 14:
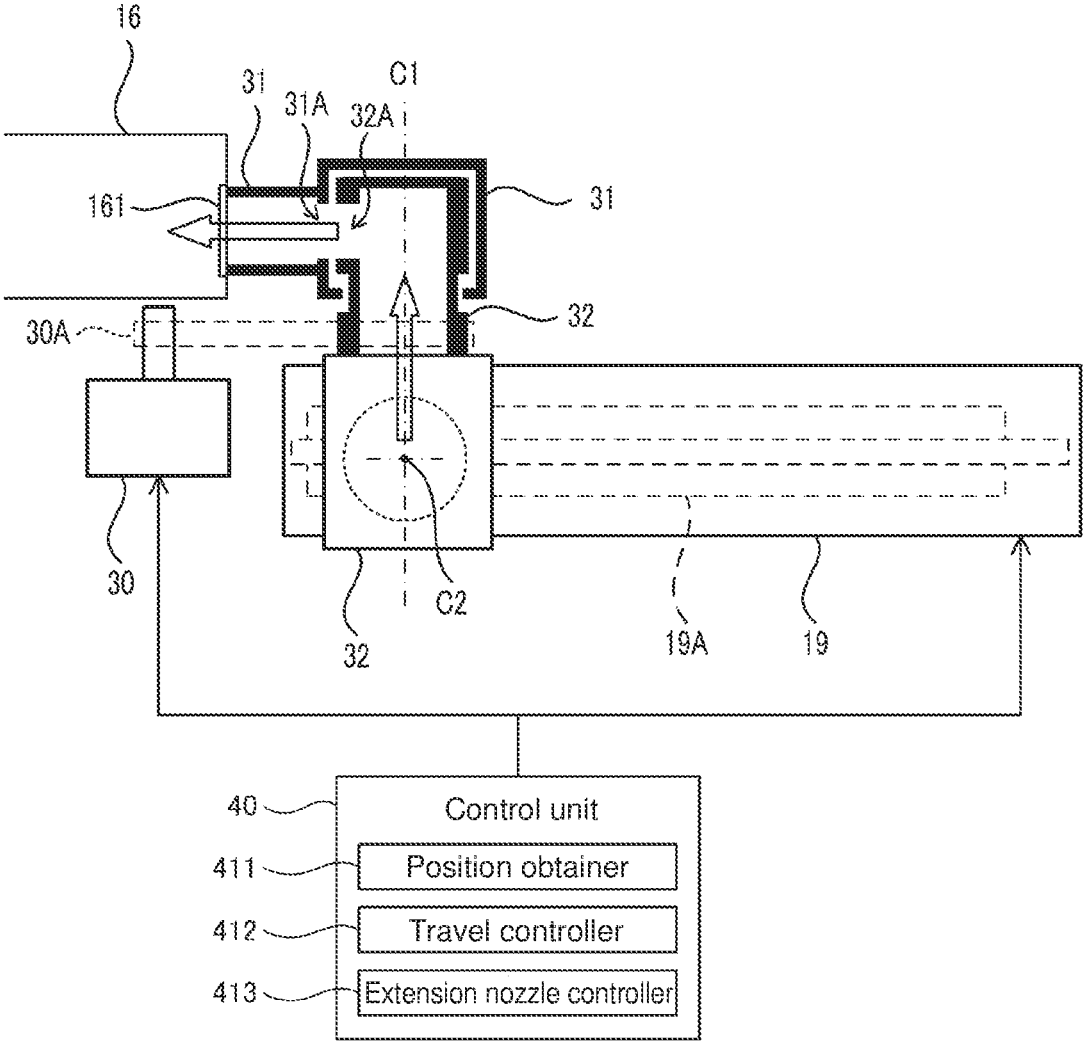
FIG. 14 is a schematic diagram illustrating a pivoting assembly for the extension nozzle as viewed from above.
Figure 15:
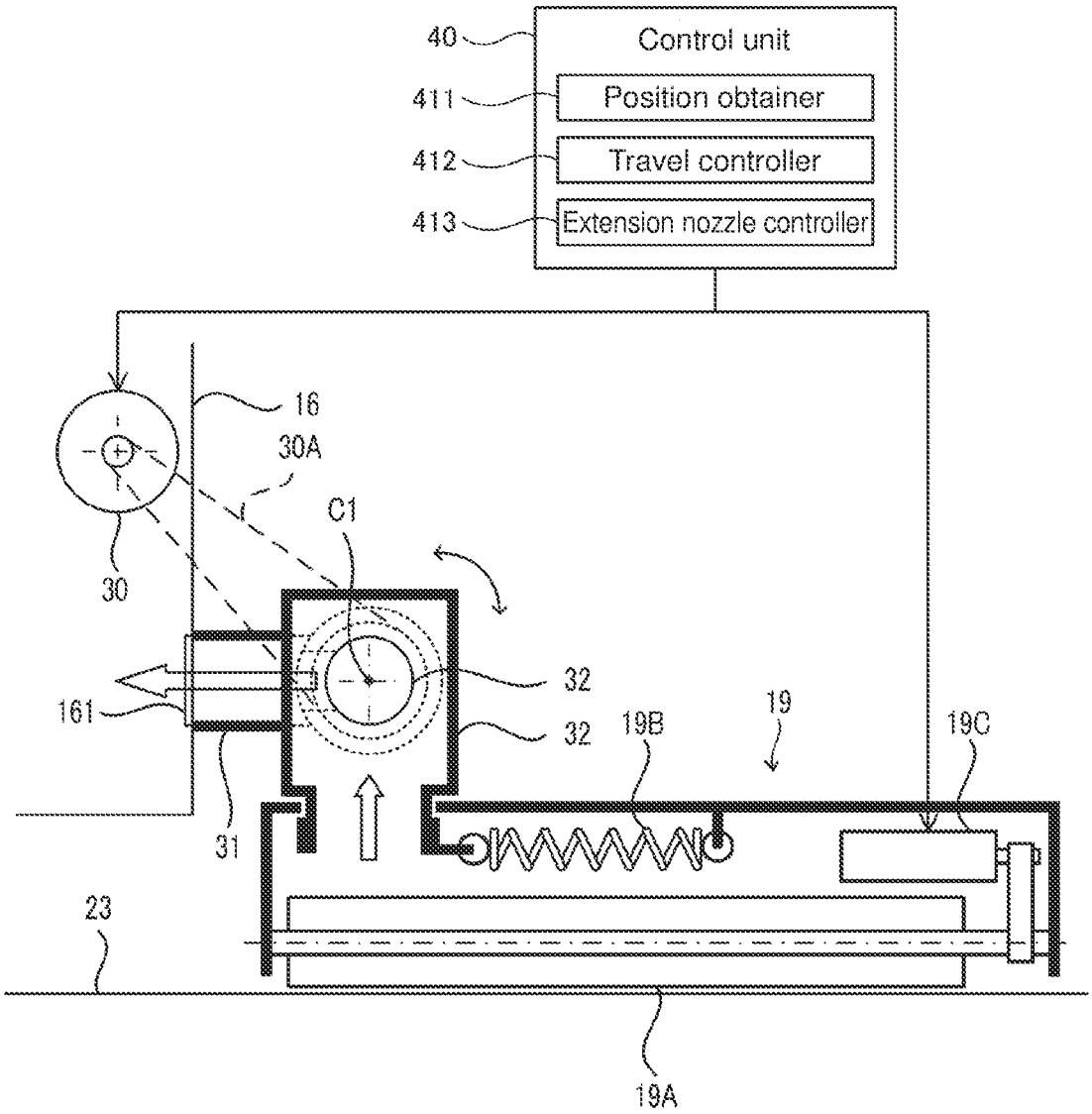
FIG. 15 is a schematic diagram illustrating the pivoting assembly for the extension nozzle as viewed from behind.

FIGS. 14 and 15 are schematic diagrams illustrating the extension nozzle 19 showing its specific structure. The extension nozzle 19 is pivotably connected to extension nozzle holders 31 and 32. As shown in FIG. 14, the extension nozzle holder 31 has one end fixed at the opening 178 (refer to FIG. 7) of the box compartment 172 and the other end receiving one end of the extension nozzle holder 32. The extension nozzle holder 32 is connected to the extension nozzle holder 31 in a manner pivotable about the pivot shaft C1 (refer to FIGS. 14 and 15). As shown in FIG. 15, the other end of the extension nozzle holder 32 is received in the extension nozzle 19. The extension nozzle 19 is connected to the extension nozzle holder 32 in a manner pivotable about the pivot shaft C2 (refer to FIG. 14). The extension nozzle holder 32 is connected to a belt 30A for transmitting the rotational driving force from the motor 30.

The control unit 40 includes various processing units such as a position obtainer 411, a travel controller 412, and an extension nozzle controller 413. The control unit 40 causes the CPU to perform various processes in accordance with various control programs, thus serving as the various processing units. At least one of the processing units included in the control unit 40 may include an electronic circuit.

The position obtainer 411 obtains the current position of the floor cleaner 10. The travel controller 412 controls operations including traveling of the floor cleaner 10, driving of the suction fans 151, and raising and lowering of the support holder 17, as described above. For example, the travel controller 412 controls traveling of the floor cleaner 10 on a preset traveling route based on the current position obtained by the position obtainer 411.

The extension nozzle controller 413 outputs the first control signal and the second control signal based on the current position obtained by the position obtainer 411. In response to the first control signal or the second control signal from the extension nozzle controller 413, the motor 30 is driven to cause the extension nozzle holder 32 to pivot about the pivot shaft C1 through the belt 30A, which causes the extension nozzle 19 to switch between the retracted posture and the lateral cleaning posture.

The extension nozzle holder 32 has an opening 32A (refer to FIG. 14). When the extension nozzle 19 switches from the retracted posture to the lateral cleaning posture, the opening 32A aligns with an opening 31A of the extension nozzle holder 31, and communicates with the internal space of the extension nozzle holder 31, which allows communication between the internal spaces of the extension nozzle holders 31 and 32, and thus allows communication between the extension nozzle 19 and the collection box 16. In other words, when the extension nozzle 19 is in the lateral cleaning posture, an airflow path forms from the extension nozzle 19 to the collection box 16. Thus, the collection box 16 can collect, through the side inlet 161 (refer to FIG. 11), dust suctioned by the extension nozzle 19 together with air.

When the extension nozzle holder 32 pivots about the pivot shaft C1 to switch the extension nozzle 19 to the retracted posture, the opening 32A is out of alignment with the opening 31A of the extension nozzle holder 31, thus blocking the airflow path from the extension nozzle 19 to the collection box 16. When the extension nozzle 19 is in the retracted posture, the collection box 16 collects, through the inlet 168, debris suctioned by the suction nozzle 18. When the extension nozzle 19 is in the lateral cleaning posture, the collection box 16 collects, through the inlet 168, debris suctioned by the suction nozzle 18, and also collects, through the side inlet 161, debris suctioned by the extension nozzle 19.

In the above described manner, the floor cleaner 10 collects, into the collection box 16, debris suctioned by the suction nozzle 18 and debris suctioned by the extension nozzle 19 through different paths. In some embodiments, when the extension nozzle 19 is in the lateral cleaning posture, the floor cleaner 10 may stop driving the suction nozzle 18 and drive the extension nozzle 19 alone to collect debris suctioned by the extension nozzle 19.

As shown in FIG. 15, the extension nozzle 19 includes a coil spring 19B (an example of a retainer in an aspect). The coil spring 19B has one end fixed to the extension nozzle holder 32, and the other end fixed to the body (exterior frame) of the extension nozzle 19. The extension nozzle 19 is retained by the coil spring 19B to extend in a direction orthogonal to the traveling direction of the floor cleaner 10. In other words, the extension nozzle 19 is retained by the coil spring 19B to extend along an extension of the rotary brushes 26. For example, the coil spring 19B includes a tension coil spring designed to receive a tensile force when the extension nozzle 19 is at a position shown in FIG. 14 (retention position). When the floor cleaner 10 receives an external force applied from an obstacle or other objects to the extension nozzle 19 during traveling, the extension nozzle 19 pivots rearward about the pivot shaft C2 against the tensile force from the coil spring 19B. When the extension nozzle 19 moves away from the obstacle, the tensile force from the coil spring 19B causes the extension nozzle 19 to pivot about the pivot shaft C2 to return to the retention position. Although the coil spring 19B is used as an example elastic member in a present embodiment, the coil spring 19B may be replaced with, for example, an elastic cord formed from rubber.

As shown in FIG. 15, the extension nozzle 19 includes the motor 19C. The motor 19C receives a control signal (drive signal) from the travel controller 412 of the control unit 40. The motor 19C generates a driving force in accordance with the control signal to drive the extension brush 19A to pivot.

Thus, the extension nozzle 19 is pivotable in a direction to reduce a collision force upon colliding with obstacles, walls, or other objects, which avoids damage to the extension nozzle 19, obstacles, walls, or other objects. The extension nozzle 19 may also be pivotable in the traveling direction such that, upon colliding with obstacles, walls, or other objects rearward from the extension nozzle 19, the extension nozzle 19 may also pivot in the same manner to avoid damage.

Figure 16:
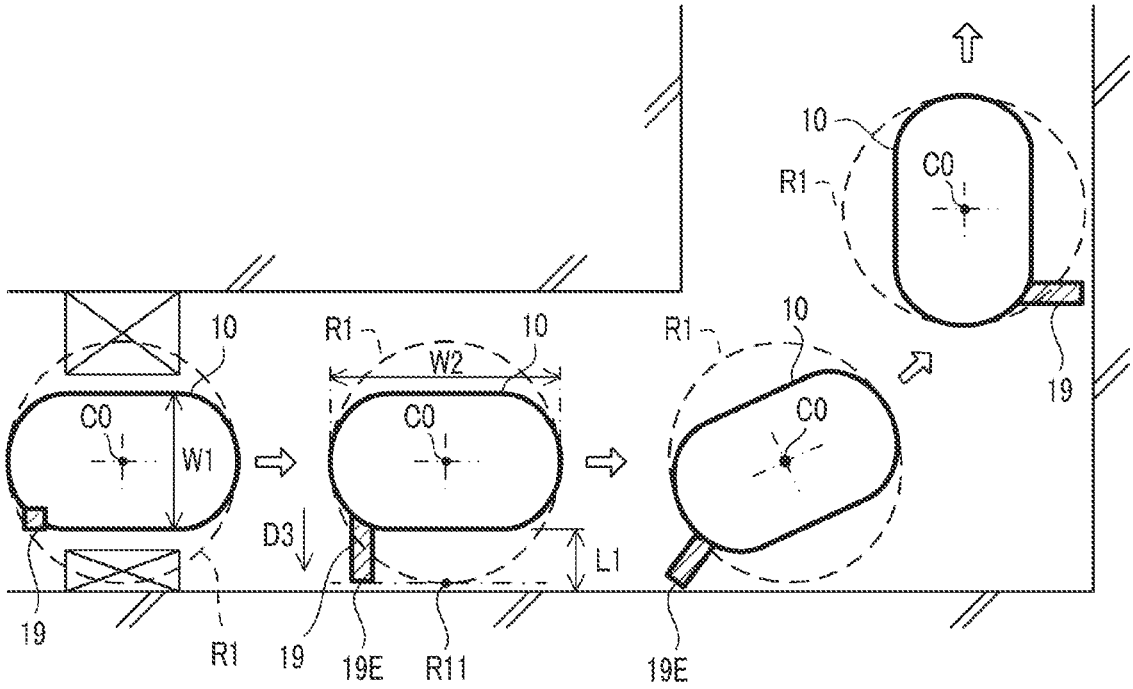
FIG. 16 is a schematic diagram illustrating a floor cleaner illustrating its travel according to one or more embodiments.

FIG. 16 is a schematic diagram illustrating the floor cleaner 10 illustrating its travel according to a present embodiment. FIG. 16 shows the floor cleaner 10 passing through a narrow passageway, then traveling and cleaning near a wall, and then changing its traveling direction (turning) upward in FIG. 16. When changing the direction, the floor cleaner 10 turns about the rotation center C0 (rotation axis). FIG. 16 shows the turning range R1 of the floor cleaner 10. As shown in FIG. 16, the floor cleaner 10 approaches the wall and travels along the wall surface to have its turning range R1 excluding the wall surface. For example, a predetermined distance L1 is set for the floor cleaner 10. The predetermined distance L1 corresponds to a position outside an end R11 of the turning range R1 in the width direction D3. When the distance between a side surface of the floor cleaner 10 and the wall surface reaches the predetermined distance L1, the travel controller 412 controls the floor cleaner 10 to travel parallel to the wall surface. The floor cleaner 10 can thus avoid contact with the wall surface when, for example, the floor cleaner 10 turns about the rotation center C0.

In response to the floor cleaner 10 approaching the wall, the control unit 40 outputs, to the motor 30, the first control signal (drive signal) for switching the extension nozzle 19 from the retracted posture to the lateral cleaning posture. In response to the first control signal, the extension nozzle 19 switches to the lateral cleaning posture by pivoting about the pivot shaft C1 toward the floor surface 23. As shown in FIG. 16, in the lateral cleaning posture, the extension nozzle 19 has a protruding end 19E in the width direction D3 generally (or substantially) aligning with the end R11 of the turning range R1 of the floor cleaner 10 in the width direction D3 when the floor cleaner 10 is viewed in the traveling direction. The width direction D3 is orthogonal to the traveling direction and corresponds to the width direction in an aspect.

For example, the length (L10) of the extension nozzle 19 is set to the value written as L10=(W2−W1)/2, where L10 is the length of the extension nozzle 19 from the side surface of the floor cleaner 10, W1 is the width of the floor cleaner 10, and W2 is the depth of the floor cleaner 10.

As shown in FIG. 16, the travel controller 412 can cause the floor cleaner 10 to travel along the wall surface while keeping the predetermined distance L1 from the wall surface and having the turning range R1 of the floor cleaner 10 excluding the wall surface in a plan view such that, when the extension nozzle 19 is in the lateral cleaning posture, the distance from the protruding end 19E of the extension nozzle 19 to the wall surface is the same as the distance from the end R11 of the turning range R1 to the wall surface, keeping a predetermined clearance between the protruding end 19E and the wall surface. Thus, the extension nozzle 19 has the protruding end 19E out of contact with the wall surface keeping a predetermined clearance from the wall surface when the floor cleaner 10 travels parallel to the wall surface at the distance to the wall surface reaching the predetermined distance L1, which allows the floor cleaner 10 to travel and clean near the wall surface with the extension nozzle 19 out of contact with the wall surface.

When traveling and cleaning near the wall and then changing the traveling direction (or turning) upward as shown in FIG. 16, the floor cleaner 10 can avoid having the right rear end of its body in contact with the wall surface. When the floor cleaner 10 changes the direction, the extension nozzle 19 comes in contact with the wall surface but pivots rearward about the pivot shaft C2 (refer to FIG. 14), which avoids damage to the extension nozzle 19. When the floor cleaner 10 completes changing the direction, the extension nozzle 19 pivots forward about the pivot shaft C2 to return to its original position.

The floor cleaner 10 according to a present embodiment described above has an elongated profile having a larger dimension in the traveling direction (depth W2) than its dimension in the width direction D3 (width W1). The floor cleaner 10 having such a profile provides a space for accommodating the functional units (e.g., a battery) in the body, and can also travel on and clean narrow passageways. The floor cleaner 10 includes the extension nozzle 19 switchable between the retracted posture and the lateral cleaning posture. In the lateral cleaning posture, the extension nozzle 19 has the protruding end 19E in the width direction D3 aligning with the end R11 of the turning range R1 of the floor cleaner 10 in the width direction D3 when the floor cleaner 10 is viewed in the traveling direction. The floor cleaner 10 with the above described structure can travel and clean near the wall with the extension nozzle 19 out of contact with the wall surface by keeping the predetermined distance L1 (refer to FIG. 16) from the wall surface and having the turning range R1 excluding the wall surface. When changing its direction (turning), the floor cleaner 10 avoids contact of its body with the wall surface. The floor cleaner 10 also avoids damage to the extension nozzle 19 by pivoting the extension nozzle 19 rearward about the pivot shaft C2 (refer to FIG. 14) upon contact with the wall surface. Thus, the floor cleaner 10 in an aspect has a space for accommodating the functional units and can travel on and clean narrow passageways with improved cleaning efficiency near walls.

Figure 17:
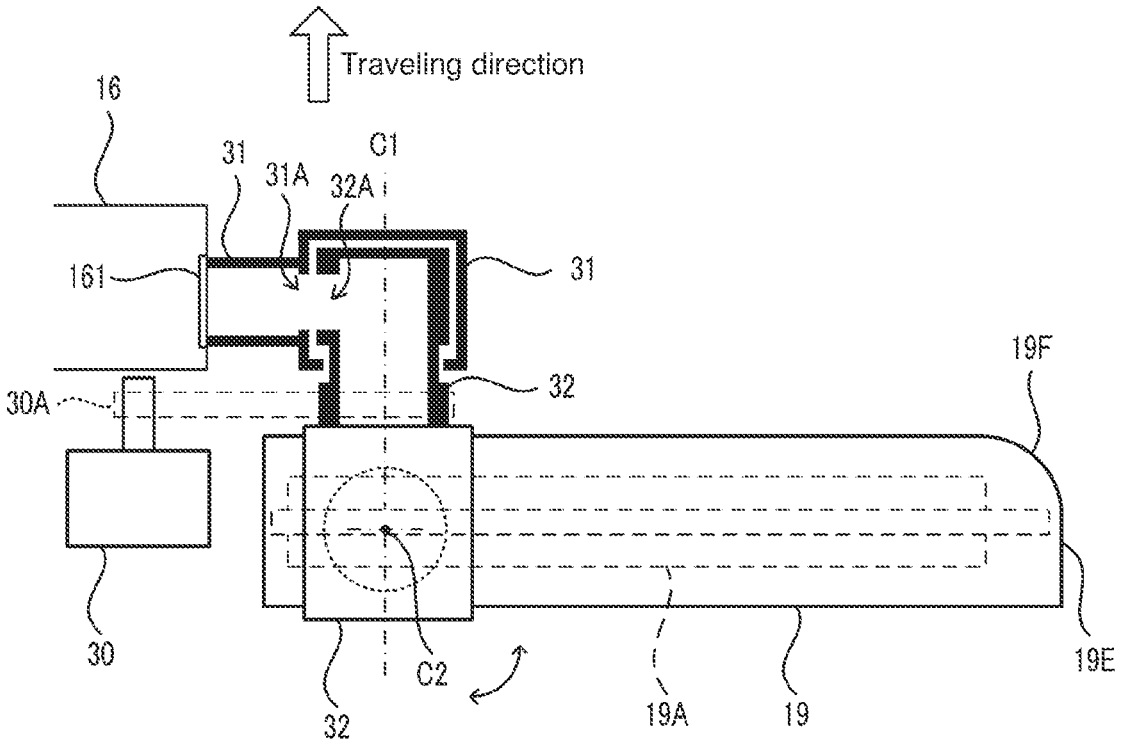
FIG. 17 is a schematic diagram illustrating an extension nozzle according to a modification as viewed from above.
Figure 18:
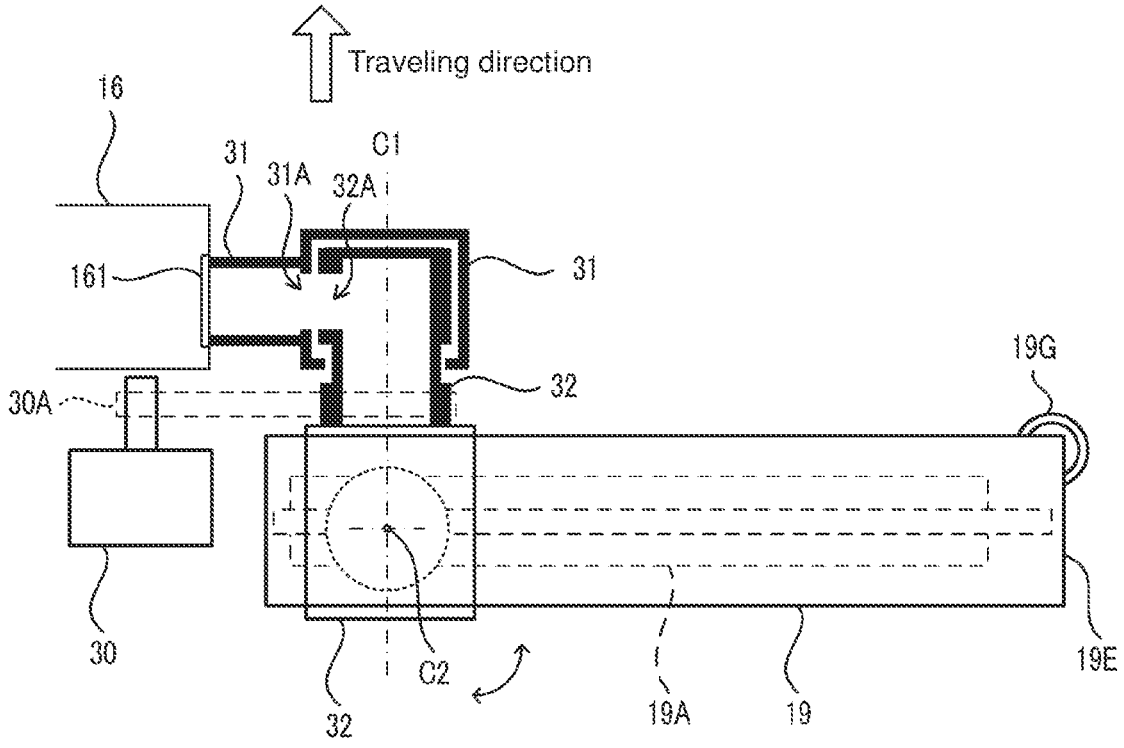
FIG. 18 is a schematic diagram illustrating an extension nozzle according to a modification as viewed from above.

The autonomous traveling cleaner according to one or more embodiments is not limited to the above description. As shown in FIG. 17, for example, the protruding end 19E of the extension nozzle 19 may have a corner in the traveling direction with an arc-shaped surface 19F (or sloped surface) (an arc-shaped or a sloped corner) in a plan view of the floor cleaner 10. As shown in FIG. 18, the extension nozzle 19 may have a roller 19G on a corner of the protruding end 19E in the traveling direction. The structures shown in FIGS. 17 and 18 allow the extension nozzle 19 to easily pivot rearward upon contact with a wall surface when the floor cleaner 10 changes the direction (or turns), which effectively avoids damage to the extension nozzle 19.

Figure 19:
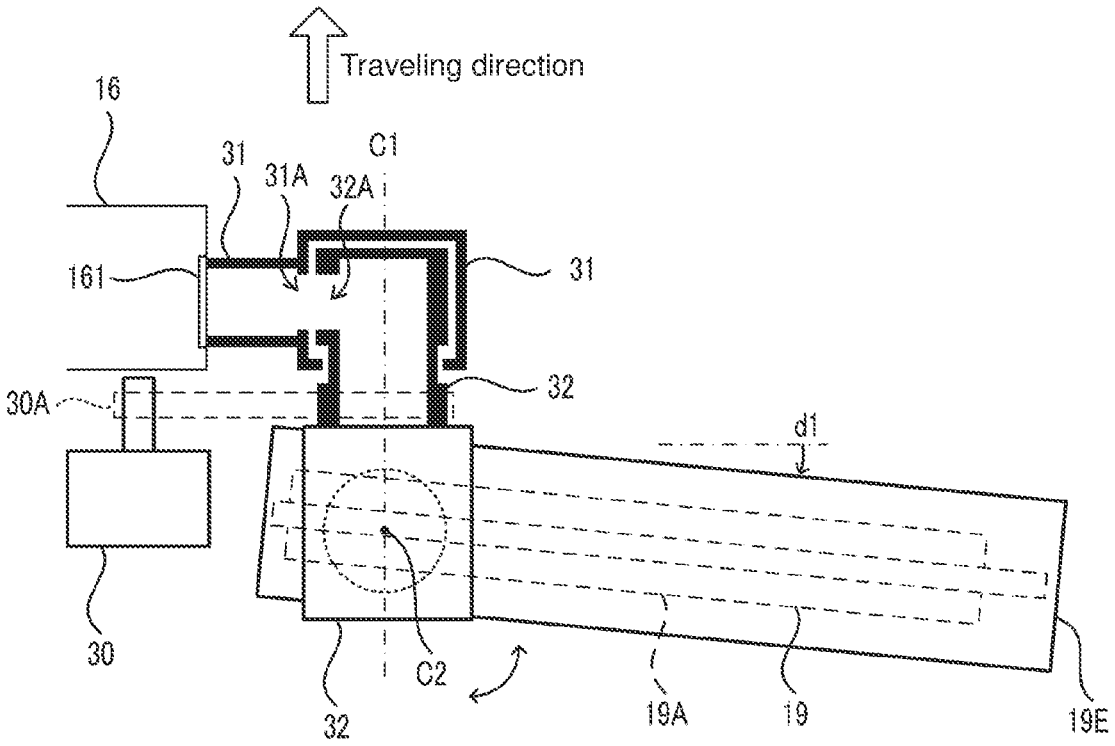
FIG. 19 is a schematic diagram illustrating an extension nozzle according to a modification as viewed from above.

As shown in FIG. 19, when the extension nozzle 19 is in the lateral cleaning posture and is not receiving an external force, the coil spring 19B (refer to FIG. 15) may retain the extension nozzle 19 tilted in a direction (rearward) opposite to the traveling direction by a predetermined angle d1 relative to the width direction D3. When the floor cleaner 10 changes the direction (or turns), the extension nozzle 19 more easily pivots rearward upon contact with a wall surface, which effectively avoids damage to the extension nozzle 19. The extension nozzle 19 may include two or more of the structures shown in FIGS. 17 to 19 combined together.

Figure 20:
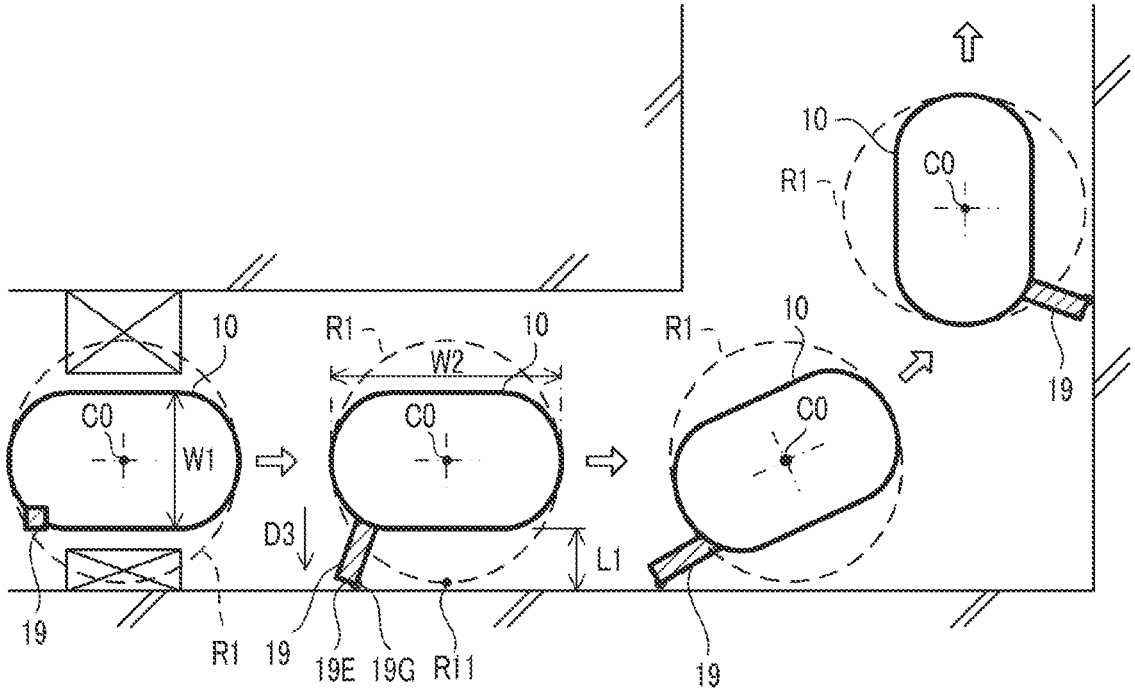
FIG. 20 is a schematic diagram illustrating a floor cleaner illustrating the travel thereof according to one or more embodiments.

In some embodiments, in the lateral cleaning posture, the extension nozzle 19 may have the protruding end 19E in the width direction D3 outside the turning range R1 when the floor cleaner 10 is viewed in the traveling direction. In other words, the extension nozzle 19 may have a length to protrude from the turning range R1 such that the extension nozzle 19 may come in contact with a wall surface at the distance between the floor cleaner 10 and the wall surface yet to reach the predetermined distance L1 as shown in, for example, FIG. 20. Thus, the floor cleaner 10 travels near the wall, with the extension nozzle 19 in contact with the wall surface. The extension nozzle 19 can thus clean a corner of the wall surface. As shown in FIG. 20, the extension nozzle 19 may include, at a corner of the protruding end 19E, the roller 19G (refer to FIG. 18) rotatable upon contact with the wall surface.

The extension nozzle 19 may be located in a right portion of the support holder 17, or may be located in each of right and left portions of the support holder 17. When the extension nozzle 19 is located in each of right and left portions, the two extension nozzles 19 may be controlled independently of each other by the control unit 40 (extension nozzle controller 413). The extension nozzle 19 may be manually switchable between the retracted posture and the lateral cleaning posture.

Figure 21:
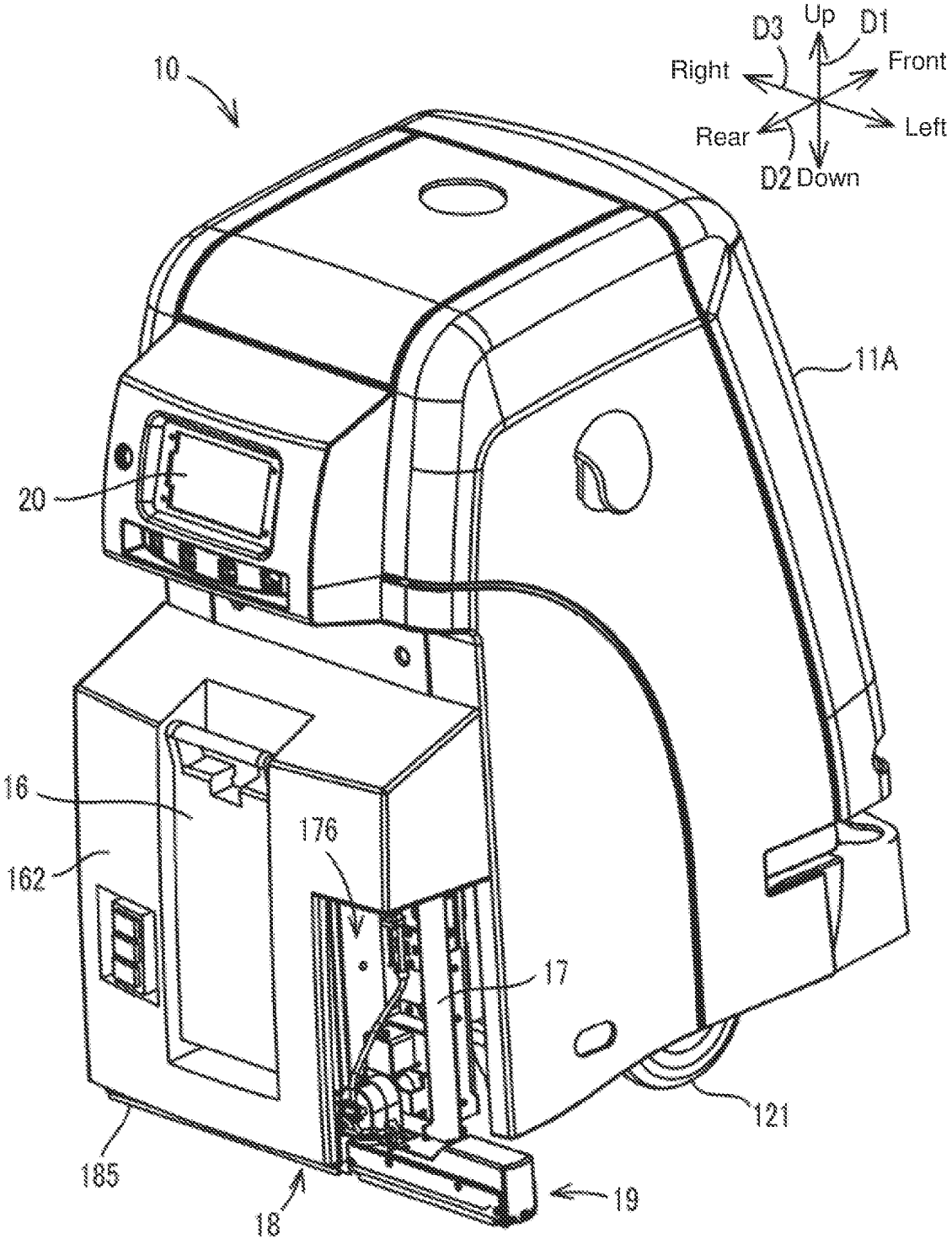
FIG. 21 is a diagram illustrating an external rear perspective view of a floor cleaner according to a modification.

The structure of the floor cleaner 10 is not limited to the structure shown in FIG. 1. As shown in FIG. 21, for example, a floor cleaner 10 according to a modification may include a collection box 16 exposed through a body 11. The collection box 16 may be detachable from the body 11 without a cover 162 or a door (not shown) being removed.

The invention claimed is:

1. An autonomous traveling cleaner for traveling autonomously on a target surface and cleaning the target surface, the autonomous traveling cleaner comprising:

a driving force transmitter configured to transmit, to the target surface, a moving force of the autonomous traveling cleaner in a traveling direction with a body of the autonomous traveling cleaner in a traveling posture;

a suction nozzle comprising a first rotary brush configured to sweep the target surface, the suction nozzle being configured to suction first suction matter collected by the first rotary brush;

an extension nozzle extendable laterally with respect to the traveling direction and including a second rotary brush configured to sweep the target surface, the extension nozzle being configured to suction second suction matter collected by the second rotary brush; and a collection box comprising an inlet, the collection box being configured to collect, through the inlet, the first suction matter suctioned by the suction nozzle and the second suction matter suctioned by the extension nozzle, wherein the autonomous traveling cleaner has an elongated profile having a larger dimension in the traveling direction than in a width direction orthogonal to the traveling direction, the extension nozzle is switchable between a first posture and a second posture, the extension nozzle in the first posture is positioned without laterally protruding from the autonomous traveling cleaner and has an airflow path being blocked from the extension nozzle to the collection box, the extension nozzle in the second posture is positioned to laterally protrude from the autonomous traveling cleaner and has an airflow path forming from the extension nozzle to the collection box, the extension nozzle in the second posture is pivotable in a direction opposite to the traveling direction, and the extension nozzle in the second posture has a protruding end in the width direction to be aligned with an end of a turning range of the autonomous traveling cleaner in the width direction, in response to the autonomous traveling cleaner is viewed in the traveling direction.

2. The autonomous traveling cleaner according to claim 1, wherein the protruding end of the extension nozzle has an arc-shaped corner in the traveling direction in a plan view of the autonomous traveling cleaner.

3. The autonomous traveling cleaner according to claim 1, wherein the extension nozzle includes a roller on a corner of the protruding end in the traveling direction in a plan view of the autonomous traveling cleaner.

4. The autonomous traveling cleaner according to claim 1, further comprising a travel controller configured to control traveling of the autonomous traveling cleaner, wherein the travel controller causes the autonomous traveling cleaner to travel along a wall surface within the turning range to exclude the wall surface in a plan view of the autonomous traveling cleaner.

5. The autonomous traveling cleaner according to claim 1, wherein the extension nozzle switches from the first posture to the second posture in response to the autonomous traveling cleaner traveling at a preset place on a traveling route.

6. The autonomous traveling cleaner according to claim 1, further comprising a retainer configured to apply an urging force to the extension nozzle to retain the extension nozzle in the second posture, wherein in response to an external force applied to the extension nozzle, the retainer causes, against the urging force, the extension nozzle to pivot, from the second posture, in a direction in which the external force is applied, and returns the extension nozzle in the second posture with the urging force in response to the external force removed from the extension nozzle.

7. The autonomous traveling cleaner according to claim 6, wherein the retainer includes a tension coil spring, the tension coil spring has an end fixed to the extension nozzle, and the tension coil spring applies a tensile force to the extension nozzle to retain the extension nozzle in the second posture.

8. The autonomous traveling cleaner according to claim 6, wherein the retainer retains the extension nozzle tilted opposite to the traveling direction at a predetermined angle with respect to the width direction in response to the extension nozzle is in the second posture and free from the external force.

9. The autonomous traveling cleaner according to claim 1, wherein the inlet includes a first inlet in a bottom surface of the collection box, and a second inlet in a side surface of the collection box, the collection box collects, through the first inlet, the first suction matter suctioned by the suction nozzle and stops collection with the extension nozzle in response to the extension nozzle is in the first posture, and the collection box collects, through the first inlet, the first suction matter suctioned by the suction nozzle and collects, through the second inlet, the second suction matter suctioned by the extension nozzle in response to the extension nozzle is in the second posture.

* * * * *